United States Patent [19]

Nakazyo et al.

[11] 4,120,725

[45] Oct. 17, 1978

[54] COLOR PHOTOGRAPHIC LIGHT-SENSITIVE MATERIAL

[75] Inventors: Kiyoshi Nakazyo; Shinji Sakaguchi; Nobuo Tsuji, all of Minami Ashigara, Japan

[73] Assignee: Fuji Photo Film Co., Ltd., Minima Ashigara, Japan

[21] Appl. No.: 771,704

[22] Filed: Feb. 24, 1977

[30] Foreign Application Priority Data

Feb. 24, 1976 [JP] Japan ..... 51-19214

[51] Int. Cl.[2] ..... G03C 1/10; G03C 1/40

[52] U.S. Cl. ..... 96/97; 96/100 R; 96/114

[58] Field of Search ..... 96/97, 98, 100, 114

[56] References Cited

U.S. PATENT DOCUMENTS

| | | | |
|---|---|---|---|
| 2,772,163 | 11/1956 | Tong | 96/47 |
| 2,852,382 | 9/1958 | Illingsworth et al. | 96/114 |
| 2,893,867 | 7/1959 | Dawson et al. | 96/98 |
| 3,252,801 | 5/1966 | Cohen et al. | 96/114 |
| 3,523,906 | 8/1970 | Vrancken et al. | 96/97 |
| 3,536,491 | 10/1970 | Rees et al. | 96/114 |
| 3,645,911 | 2/1972 | van Besauw et al. | 96/97 |

*Primary Examiner*—Mary F. Kelley
*Attorney, Agent, or Firm*—Sughrue, Rothwell, Mion, Zinn and Macpeak

[57] ABSTRACT

A color photographic light-sensitive material having at least one silver halide photographic emulsion layer containing a hydrophobic coupler, in which the color photographic material additionally contains both a polymer having a recurring unit represented by the following general formula (I):

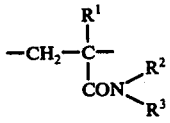

(I)

wherein $R^1$ represents a hydrogen atom or a lower alkyl group and $R^2$ and $R^3$ each represents a hydrogen atom, an aliphatic hydrocarbon group, an aromatic hydrocarbon group, an alkyl-substituted amino group or an aryl-substituted amino group, with the proviso that both of $R^2$ and $R^3$ are not simultaneously hydrogen atoms, the total number of carbon atoms in $R^2$ and $R^3$ is 4 to 12, $R^2$ and $R^3$ do not contain an acidic group, and $R^2$ and $R^3$ can combine to form a ring;

and a polymer having a recurring unit represented by the following general formula (II);

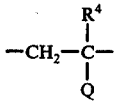

(II)

wherein $R^4$ has the same meaning as $R^1$; and Q represents (1) $-(CH_2)_pOH$, wherein $p$ represents 0 or 1,

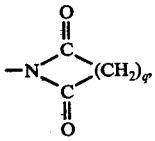

(2)

wherein $q$ represents an integer of 2 to 4,

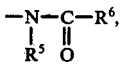

(3)

wherein $R^5$ represents an alkyl group; and $R^6$ represents a hydrogen atom or an alkyl group,

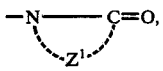

(4)

wherein $Z^1$ represents the atoms necessary to form a lactam ring, an oxazolidone ring or a pyridone ring, or

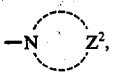

(5)

wherein $Z^2$ represents the atoms necessary to form a morpholine ring.

9 Claims, No Drawings

COLOR PHOTOGRAPHIC LIGHT-SENSITIVE MATERIAL

BACKGROUND OF THE INVENTION

1. Field of the Invention

The present invention relates to a silver halide color photographic light-sensitive material. More particularly, it relates to a color photographic light-sensitive material which has improved speed of silver removal during a step of development processing in which the silver image is removed (bleaching) after the formation of a dye image.

2. Description of the Prior Art

With respect to an incorporated coupler type color photographic light-sensitive material which contains a water soluble or organic solvent soluble diffusion resistant dye image forming coupler homogeneously or as a dispersion thereof, the purity of the dye image is adversely affected and color reproduction falls off when silver removal with an oxidizing bath after color development is insufficiently carried out.

A color photographic light-sensitive material which is applicable to rapid processing has been required more and more. Although the period of time required for developing is reduced at high processing temperatures or using a developing agent having a strong developing activity, it is difficult to shorten the overall time required for color processing due to the silver removal step which is a rate-determining step.

It is considered to be advantageous not only to increase the silver removal speed but also to save silver which is expensive. In order to solve the problem a two-equivalent type coupler is employed. The use of a two-equivalent coupler can reduce the amount of silver halide required to a range of $\frac{2}{3}$ to $\frac{1}{2}$ of that needed when a four-equivalent coupler is used and can speed up the development step. However, the removal of silver becomes rather difficult in some cases depending on the method of removing silver when a two-equivalent coupler is used. This is particularly true in a reversal color processing. Also the removal of silver is remarkably difficult when a two-equivalent coupler is present together with a development inhibitor releasing coupler or a development inhibitor releasing compound.

It is known that a copolymer of polyvinyl alcohol can be effectively used for preventing color turbidity due to insufficient silver removal as described in U.S. Pat. No. 3,730,726. "Color turbidity" means the phenomenon caused by poor silver removal after color developing a color photographic light-sensitive element in an oxidizing-bleach bath, whereby the wide spectral absorption band of the remaining silver overlaps the sharp spectral absorption band of the developed color image. It is also known that a copolymer of polyvinylpyrrolidone is effective as described in U.S. Pat. Nos. 3,730,726 and 3,655,389. However, even when such a copolymer is used the speed of removing silver is still insufficient when the intention is to process a color photographic material rapidly. In particular, when a large amount of hardener is used in a light-sensitive material in order to increase the strength of a gelatin layer, a rapid removal of silver is difficult.

SUMMARY OF THE INVENTION

It has now been found that sufficient silver removal from a color photographic light-sensitive material can be performed at a high rate which could not be achieved using methods conventionally known, by incorporating at least two polymers in combination according to the present invention into a silver halide color light-sensitive material.

An object of the present invention is to provide a color photographic light-sensitive material from which silver can be removed at a high rate during processing and which is applicable to rapid processing.

The objects of the present invention are effectively accomplished with a color photographic light-sensitive material as described below.

That is, the color photographic light-sensitive material of the present invention comprises at least one silver halide photographic emulsion layer containing a color image forming coupler and further a polymer having a recurring unit represented by the following general formula (I):

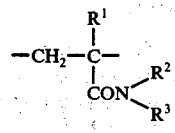

(I)

wherein $R^1$ represents a hydrogen atom or a lower alkyl group having 3 or less carbon atoms; and $R^2$ and $R^3$, which may be the same or different, each represents a hydrogen atom, an aliphatic hydrocarbon group having 1 to 12 carbon atoms, an aromatic hydrocarbon group having 6 to 12 carbon atoms, an alkyl-substituted amino group or an aryl-substituted amino group, with the proviso that both of $R^2$ and $R^3$ are not simultaneously hydrogen atoms, the total number of carbon atoms in $R^2$ and $R^3$ is 4 or more, $R^2$ and $R^3$ do not include an acidic group such as a carboxy group, a sulfo group, a sulfato group, a phospho group, a phosphono group, etc., and $R^2$ and $R^3$ can combine together to form a ring;

and a polymer having a recurring unit represented by the following general formula (II):

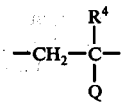

(II)

wherein $R^4$ has the same meaning as defined for $R^1$; and Q represents:

(1) $-(CH_2)_pOH$, wherein $p$ represents 0 or 1,

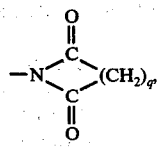

(2)

wherein $q$ represents an integer of 2 to 4,

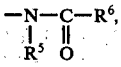

(3)

wherein $R^5$ represents an alkyl group having 1 to 4 carbon atoms; and $R^6$ represents a hydrogen atom or an alkyl group having 1 to 4 carbon atoms,

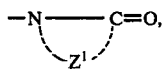

(4)

wherein $Z^1$ represents the atoms necessary to form a lactam ring, an oxazolidone ring or a pyridone ring, or

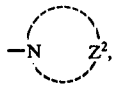

(5)

wherein $Z^2$ represents the atoms necessary to form a morpholine ring are both incorporated in a hydrophilic colloid layer thereof, preferably in the above-described silver halide emulsion layer.

DETAILED DESCRIPTION OF THE INVENTION

The aliphatic hydrocarbon group and the aromatic hydrocarbon group represented by $R^2$ and $R^3$ in the general formula (I) and the alkyl group represented by $R^4$, $R^5$ and $R^6$ include both unsubstituted and substituted groups. However, $R^2$ and $R^3$ are not substituted with an acidic group. Suitable examples of aliphatic hydrocarbon groups for $R^2$ and $R^3$ include an alkyl group such as an ethyl, n-butyl, tertbutyl, tert-octyl, etc., group, a cycloalkyl group such as a cyclohexyl, etc., group, an aralkyl group such as a benzyl, etc., group and the like. Suitable examples of aromatic hydrocarbon groups include a phenyl, naphthyl, etc., group. Suitable examples of alkyl groups having 1 to 4 carbon atoms for $R^5$ and $R^6$ include a methyl group, an ethyl group, etc.

Suitable examples of alkyl groups for $R^1$ having 3 or less carbon atoms include a methyl group, an ethyl group, a propyl group, etc., preferably a methyl group.

The aliphatic hydrocarbon group and the aromatic hydrocarbon group represented by $R^2$ and $R^3$ can be substituted, for example, with one or more of an aryl group (such as a phenyl group, etc.), an alkylamino group having 1 to 12 carbon atoms (such as a dimethylamino group, etc.), a hydroxy group, an alkoxy group having 1 to 6 carbon atoms (such as a methoxy group, etc.), a halogen atom (such as a chlorine atom, etc.), a cyano group and the like.

The alkyl-substituted amino group represented by $R^2$ and $R^3$ can be a monosubstituted or disubstituted amino group with the alkyl moiety thereof having 1 to 12 carbon atoms (such as a methyl group, an ethyl group, a butyl group, an n-amyl group, an isoamyl group, a tert-amyl group, etc.) and preferably has a total number of 4 to 12 carbon atoms.

The aryl-substituted amino group represented by $R^2$ and $R^3$ can be a monosubstituted or disubstituted amino group with the aryl moiety thereof having 6 to 12 carbon atoms (such as a phenyl group, a naphthyl group, etc.).

Suitable examples of lactam rings formed by $Z^1$ include 2-pyrrolidone, 2-piperidone, etc.

The total number of carbon atoms included in the substituents represented by $R^2$ and $R^3$ preferably ranges from 4 to 12, particularly 4 to 8 from the standpoint of affinity to a coupler, especially a hydrophobic coupler, and affinity to a hydrophilic colloid.

The heterocyclic ring which is formed by the combination of $R^2$ and $R^3$ can contain another hetero atom other than the nitrogen atom forming a part thereof, for example, an oxygen atom, a sulfur atom, a selenium atom, or another nitrogen atom, etc. Suitable examples of the heterocyclic rings formed by the combination of $R^2$ and $R^3$ include piperidine, morpholine, dimethyl morpholine, N-ethyl piperazine, etc.

The polymer having the recurring unit represented by the general formula (I) used in the present invention can be any of a homopolymer of one monomer represented by the general formula (IA), a copolymer of two or more monomers represented by the general formula (IA) and a copolymer of a monomer represented by the general formula (IA) and an addition polymerizable unsaturated compound

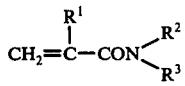

(IA)

wherein $R^1$, $R^2$ and $R^3$ each has the same meaning as defined in the general formula (I).

Specific examples of monomers represented by the general formula (IA) are, for example, N-(n-butyl)acrylamide, N-(tert-butyl)acrylamide, N-(isoamyl)acrylamide, N-(tertoctyl)acrylamide, N-laurylacrylamide, N-cyclohexylacrylamide, N-benzylacrylamide, N-(β-dimethylaminoethyl)acrylamide, N-phenylacrylamide, N-(1,1-dimethyl-3-hydroxybutyl)acrylamide, N,N-diethylacrylamide, N,N-dioctylacrylamide, N-(1,1-dimethyl-3-oxobutyl)acrylamide, N-acryloylmorpholine, N-methyl-N'-acryloylpiperazine, N-acryloylpiperidine, N-(β-morpholinoethyl)acrylamide, N-(3,5-dimethylmorpholinoethyl)acrylamide, N-acryloyl-N'-butylhydrazine, N-acryloyl-N'-phenylhydrazine, N-(tert-butyl)methacrylamide, N-(tertoctyl)methacrylamide, N-benzylmethacrylamide, N-cyclohexylmethacrylamide, N-phenylmethacrylamide, N,N-diethylmethacrylamide, N,N-dipropylmethacrylamide, N-methyl-N-phenylmethacrylamide, N-methacryloyl-N'-phenylhydrazine, N-methacryloyl-N'-butylhydrazine, N-methacryloyl-N'-methylhydrazine, N-methacryloylpiperidine, 4-methacryloyl-2,6-dimethylmorpholine, N-methacryloyl-N'-ethylpiperazine, and the like.

Suitable addition polymerizable unsaturated compounds which can be used in the copolymer together with a monomer represented by the general formula (IA) include an acrylic acid ester, a methacrylic acid ester, an allyl compound, a vinyl ether, a vinyl ester, a vinyl heterocyclic compound, a styrene, a maleic acid ester, a fumaric acid ester, an itaconic acid ester, a crotonic acid ester, an olefin, and the like.

Specific examples of such copolymerizable compounds are, for example, methyl acrylate, ethyl acrylate, n-propyl acrylate, isopropyl acrylate, n-butyl acrylate, octyl acrylate, 2-chloroethyl acrylate, 2-cyanoethyl acrylate, N-(β-dimethylaminoethyl)acrylate, benzyl acrylate, cyclohexyl acrylate, phenyl acrylate; methyl methacrylate, ethyl methacrylate, n-propyl methacrylate, isopropyl methacrylate, n-butyl methacrylate, octyl methacrylate, cyclohexyl methacrylate, benzyl methacrylate, 3-sulfopropyl methacrylate; allyl acetate, allyl caprylate, allyl caproate, allyl laurate, allyl benzoate; allyl butyl ether, allyl phenyl ether, methyl vinyl ether, butyl vinyl ether, octyl vinyl ether, methoxyethyl vinyl ether, 2-chloroethyl vinyl ether, 2-hydroxyethyl vinyl ether, 2-dimethylaminoethyl vinyl ether, vinyl phenyl ether, vinyl tolyl ether, vinyl chlorophenyl ether; vinyl acetate, vinyl propionate, vinyl butyrate, vinyl isobutyrate, vinyl methoxyacetate, vinyl phenylacetate, vinyl acetoacetate, vinyl lactate, vinyl benzoate, vinyl chlorobenzoate, vinyl naphthoate; vinyl pyridine, N-vinylimidazole, N-vinylcarbazole, vinyl thiophene; styrene, chloromethylstyrene, p-acetoxystyrene, p-methylstyrene; p-vinylbenzoic acid, methyl p-vinylbenzoate; crotonamide, butyl crotonate, glycerol monocrotonate; methyl vinyl ketone, phenyl vinyl ketone; ethylene propylene, 1-butene, dicyclopentadiene, 4-methyl-1-hexene, 4,4-dimethyl-1-pentene; methyl itaconate, ethyl itaconate, diethyl itaconate; methyl sorbate, ethyl maleate, butyl maleate, dibutyl maleate, octyl maleate; ethyl fumarate, dibutyl fumarate, octyl fumarate; a halogenated olefin, such as vinyl chloride, vinylidene chloride, isoprene, etc.; an unsaturated nitrile, such as acrylonitrile, methacrylonitrile, etc.; and the like. If desired, a mixture of two or more of the monomers can be used. Although a wide variety of monomers can be used as copolymerizable components in the copolymer, the copolymer does not include the recurring unit represented by the general formula (II) therein. Of these monomers described above, an acrylate, a methacrylate and a vinyl ester are preferred from the standpoint of solubility, oleophilicity, affinity to a hydrophobic coupler, affinity to a hydrophilic colloid and applicability to photographic processing of the copolymer. The ratio of monomers in the copolymer having the recurring unit represented by the general formula (I) is not critical, though it is preferred to use the component represented by the general formula (I) in a proportion of 5 to 100 mol%, more particularly 20 to 70 mol%. The minimum amount of the repeating unit of the formula (I) is more than about 3, preferably more than 10 per molecule.

Of the recurring unit represented by the general formula (II), units wherein $R^4$ represents a hydrogen atom and Q represents (i) —OH,

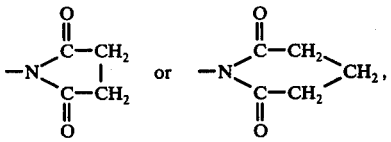

(ii)

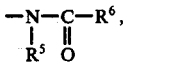

(iii)

wherein $R^5$ represents a methyl group or an ethyl group and $R^6$ represents a hydrogen atom, a methyl group or an ethyl group, or

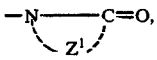

(iv)

wherein $Z^1$ represents the atoms necessary to form a 5-membered or 6-membered lactam ring or an oxazolidone ring are preferred, and units wherein Q represents —OH, a pyrrolidone residue or an oxazolidone residue are particularly preferred.

The polymer having the recurring unit represented by the general formula (II) can be not only a homopolymer but also a copolymer. That is, such polymer can be a homopolymer of one monomer represented by the general formula (IIA), a copolymer of two or more monomers represented by the general formula (IIA) and a copolymer of a monomer represented by the general formula (IIA) and an addition polymerizable unsaturated compound:

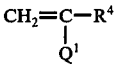

(IIA)

wherein $R^4$ has the same meaning as defined for $R^1$; and $Q^1$ represents

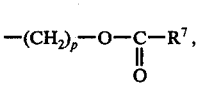

(1)

wherein $R^7$ represents a hydrogen atom, an alkyl group having 1 to 10 carbon atoms (e.g., a methyl group, an ethyl group, a propyl group, a heptyl group, etc.) or an aryl group (substituted or unsubstituted); and $p$ represents 0 or 1,

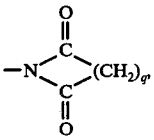

(2)

wherein $q$ represents an integer of 2 to 4,

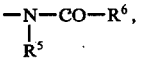

(3)

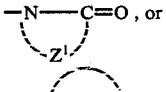

(4)

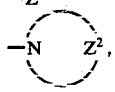

(5)

wherein $R^5$, $R^6$, $Z^1$ and $Z^2$ each has the same meaning as defined in the general formula (II). The polymer wherein $Q^1$ represents

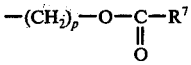

is then subjected to hydrolysis to obtain the polymer wherein Q represents $-(CH_2)_p-OH$.

The alkyl group represented by $R^7$ can be substituted, for example, with one or more of a halogen atom (such as chlorine, bromine, fluorine, etc.), an alkoxy group (such as methoxy, ethoxy, etc.), an aryl group (such as phenyl, etc.), an amino group, and the like. The aryl group represented by $R^7$ can be substituted, for example, with one or more of an alkyl group (such as methyl, ethyl, etc.), a halogen atom (such as chlorine, etc.), and the like.

Specific examples of monomers represented by the general formula (IIA) are, for example, vinyl formate, vinyl acetate, vinyl propionate, vinyl butyrate, vinyl caproate, vinyl caprylate, vinyl chloroacetate, vinyl methoxyacetate, vinyl phenylacetate, vinyl benzoate, allyl acetate, allyl propionate, N-vinylsuccinimide, N-vinylglutarimide, N-vinyladipimide, N-methyl-N-vinylformamide, N-ethyl-N-vinylformamide, N-methyl-N-vinylacetamide, N-ethyl-N-vinylacetamide, N-methyl-N-vinylpropionamide, N-vinylpyrrolidone, N-vinylpiperidone, N-vinyl-ε-caprolactam, N-vinyloxazolidone, N-vinylmorpholine, N-vinyl-2-pyridone, and the like. Of these monomers, for example, vinyl acetate, N-vinylsuccinimide, N-vinylglutarimide, N-methyl-N-vinylacetamide, N-ethyl-N-vinylacetamide, N-vinylpyrrolidone, N-vinylpiperidone, N-vinyloxazolidone, etc., are preferred. Vinyl acetate, N-vinylpyrrolidone and N-vinyloxazolidone are particularly preferred.

Suitable examples of addition polymerizable unsaturated compounds which can be used to form a copolymer together with a monomer represented by the general formula (IIA) include, in addition to those compounds described above as the monomer for preparing the copolymer together with the monomer represented by the general formula (IA), acrylamide, N-methylacrylamide, N,N-dimethylacrylamide, N-ethylacrylamide, N-(β-hydroxyethyl)acrylamide, methacrylamide, N-methylmethacrylamide, and the like. Of these monomers, acrylic acid, methacrylic acid, 2-hydroxyethyl acrylate, 2-methoxymethyl acrylate, sulfopropyl acrylate, acrylamide, dimethylacrylamide, 2-acryloylamino-2-methylpropane sulfonic acid, hydroxyethylacrylamide, methacrylamide, methyl vinyl ether, sodium styrene sulfonate, N-vinyl-3,5-dimethyltriazole, maleic anhydride, etc., are preferred from the standpoint of the hydrophilic property of the copolymer prepared. The ratio of monomers in the copolymer having the recurring unit represented by the general formula (II) is not critical, although it is preferred to use the component represented by the general formula (II) in a portion of 10 to 100 mol%, more particularly 50 to 100 mol%. The minimum amount of the repeating unit of the general formula (II) is more than about 10, preferably more than 20 per molecule.

The homopolymer and copolymer having therein the recurring unit represented by the general formula (I) or (II) can be prepared with reference to methods such as those described in British Pat. No. 1,211,039, Japanese Pat. Publication 29195/1972, Japanese Patent Applications (OPI) 76593/1973, 92022/1973, 21134/1974 and 120634/1974, British Pat. No. 961,395, U.S. Pat. Nos. 3,227,672, 3,290,417, 3,262,919, 3,245,932, 2,681,897 and 3,230,275, John C. Petropoulos et al., Official Digest, Vol. 33, pages 719 to 736 (1961), Syunsuke Murabayashi et al., Goseikobunshi (Synthetic Polymer), Vol. 1, pages 246 to 290, ibid., Vol. 3, pages 1 to 108, etc. Of course, the polymerization initiator employed, the concentration, the polymerization temperature, and the reaction time can be varied over a wide range and with ease.

For instance, the polymerization can be carried out at a temperature generally of about 20° to about 180° C., preferably 40° to 120° C. using generally about 0.05 to about 5% by weight, based on the total weight of monomers, of a radical polymerization initiator. An azobis compound, a peroxide, a hydroperoxide, a redox catalyst, etc., for example, potassium persulfate, tert-butyl peroctoate, benzoyl peroxide, azobisisobutylonitrile, etc., can be used as the polymerization initiator.

Specific but non-limiting examples of the synthesis of the polymer used in this invention are set forth below in greater detail. Unless otherwise indicated, all parts, percents, ratios and the like are by weight.

SYNTHESIS EXAMPLE 1

Preparation of Copolymer of N,N-Diethylacrylamide and Butylacrylate (molar ratio: 40:60)

In an oil bath was placed a 300 ml four-necked flask provided with a stirrer, a thermometer, an inlet pipe for nitrogen gas, a dropping funnel and a reflux condenser. After the air in the flask was replaced by nitrogen gas, 50 ml of ethyl acetate was poured into the flask. Then 59.72 g of diethylacrylamide, 90.28 g of n-butylacrylate and 1.169 g of 2,2'-azobis-(2,4-dimethylvaleronitrile) were dissolved and mixed and the resulting mixture was charged into the dropping funnel. After the oil bath was heated to increase the temperature, the ethyl acetate began to reflux. The monomers in the dropping funnel were added dropwise to the reaction flask over a period of about 2 hours with stirring by bubbling nitrogen gas slowly therethrough. After the completion of the dropwise addition, 0.292 g of 2,2'-azobis-(2,4-dimethylvaleronitrile) was added to the reaction mixture and ethyl acetate was distilled out slowly. The inside temperature of the flask was increased to 100° C. and stirring was continued for 1 hour. Thereafter the temperature of the flask was decreased and 75 ml of ethyl acetate was added thereinto. The limiting viscosity of the product measured in ethyl acetate at 30° C. was 0.52.

SYNTHESIS EXAMPLE 2

Preparation of Copolymer of N-(1,1-Dimethyl-3-oxobutyl)-acrylamide and Butylacrylate (molar ratio: 40:60)

The same type of apparatus as described in Synthesis Example 1 was used. In the dropping funnel were placed 46.85 g of N-(1,1-dimethyl-3-oxobutyl)acrylamide, 53.15 g of butylacrylate, 0.688 g of 2,2'-azobis-(2,4-dimethylvaleronitrile) and 50 ml of ethyl acetate and they were mixed and dissolved. The resulting mixture was added dropwise to the reaction system at the reflux temperature over a period of about 2 hours with stirring while passing nitrogen gas therethrough. After the completion of the dropwise addition, 0.172 g of 2,2'-azobis-(2,4-dimethylvaleronitrile) was added to the reaction mixture and ethyl acetate was distilled off. Then, the temperature of the flask was increased to about 100° C. at which temperature stirring was continued for an additional 2 hour period. Thereafter, the temperature of the flask was decreased and 125 ml of ethyl acetate was added to complete the reaction. The limiting viscosity of the product measured in ethyl acetate at 30° C. was 0.38.

SYNTHESIS EXAMPLE 3

Preparation of Copolymer of N-Methyl-N'-methacryloylpiperazine and 2-Ethoxyethylacrylate (molar ratio: 30:70)

On a steam bath was placed a three-necked flask provided with a stirrer, an inlet pipe for nitrogen gas, a thermometer and a reflux condenser. The air in the flask was replaced by nitrogen gas. In the flask was placed 33.33g of N-methyl-N'-methacryloylpiperazine, 66.67 g of 2-ethoxyethylacrylate, 10 ml of isopropyl alcohol, 190 ml of ethyl acetate, 1.02 g of 2,2'-azobis-(4-methoxy-2,4-dimethylvaleronitrile) which were mixed and dissolved. Then the temperature was increased to 80° C. at which stirring was continued for 3 hours. Thereafter, 0.51 g of 2,2'-azobis-(4-methoxy-2,4-dimethylvaleronitrile) was added to the reaction mixture and the resulting mixture was further stirred for 2 hours to complete the reaction. The limiting viscosity of the product measured in ethyl acetate at 30° C. was 0.08.

SYNTHESIS EXAMPLE 4

Preparation of Copolymer of N-Vinylpyrrolidone and 2-Hydroxyethylacrylate (molar ratio: 80:20)

On a steam bath was placed a four-necked flask provided with a stirrer, an inlet pipe for nitrogen gas, a thermometer, and two dropping funnels. The air in the flask was replaced by nitrogen gas. 40 ml of ethanol and 10 ml of water were placed in the flask which was heated to 65° C. In one of the dropping funnels were added 79.29 g of vinylpyrrolidone, 20.71 g of 2-hydroxyethylacrylate, 50 ml of ethanol, and 25 ml of water and in the other 175 ml of an aqueous solution having dissolved 0.484 g of 2,2'-azobis-(2-amidinopropane) hydrochloride. The solutions in both dropping funnels were added dropwise over a 2 hour period respectively, while stirring at 65° C. 30 minutes after the completion of the dropwise addition, 100 ml of an aqueous solution having dissolved therein 0.484 g of 2,2'-azobis-(2-amidinopropane) hydrochloride was further added dropwise over a 2 hour period. Thereafter, the temperature was increased to 80° C., at which stirring was contunued for 1 hour, and then the temperature was decreased. The reaction mixture was placed in a cellulose tube and dialyzed in tap water for about 24 hours and freeze-dried. The yield was 98 g and the limiting viscosity measured in water at 30° C. was 0.35.

The molecular weight of both of the polymers used in the present invention is generally about 2,000 to about 3,000,000. A polymer having a molecular weight of about 8,000 to 700,000 is preferably used. However, these values are merely exemplary and it is to be emphasized they are not critical to achieve the objects of the present invention.

Specific examples of typical polymers having therein the recurring unit represented by the general formula (I) which can be used in the present invention are illustrated in the following.

(1) Poly(N-tert-butylacrylamide)
(2) Poly[N-(1,1-dimethyl-3-oxo-butyl)acrylamide]
(3) Poly(N,N-dibutylacrylamide)
(4) Poly(N-octylmethacrylamide)
(5) Copolymer of N,N-diethylacrylamide and butylacrylate (molar ratio: 40:60)
(6) Copolymer of N,N-diethylacrylamide and 2-butoxyethylacrylate (molar ratio: 50:50)
(7) Copolymer of N-tert-butylacrylamide and butylacrylate (molar ratio: 60:40)
(8) Copolymer of N-tert-octylacrylamide and 2-ethylhexylacrylate (molar ratio: 50:50)
(9) Copolymer of N,N-dibutylacrylamide and dibutylmaleate (molar ratio: 70:30)
(10) Copolymer of N-(1,1-dimethyl-3-oxobutyl)acrylamide and butylacrylate (molar ratio: 40:60)
(11) Copolymer of N-(1,1-dimethyl-3-oxobutyl)acrylamide and butylacrylate (molar ratio: 50:50)
(12) Copolymer of N-tert-butylacrylamide and butylacrylate (molar ratio: 50:50)
(13) Copolymer of N-octyl-N-ethylacrylamide and ethylacrylate (molar ratio: 30:70)
(14) Copolymer of N-butylmethacrylamide and 2-ethylhexylacrylate (molar ratio: 50:50)
(15) Copolymer of N,N-dibutylmethacrylamide and propylacrylate (molar ratio: 35:65)
(16) Copolymer of N-(2-phenylethyl)acrylamide and butylacrylate (molar ratio: 30:70)
(17) Copolymer of N-acryloylmorpholine and 2-ethoxyethylacrylate (molar ratio: 40:60)
(18) Copolymer of N-methyl-N'-acryloylpiperazine and butylacrylate (molar ratio: 20:80)
(19) Copolymer of N-acryloylpiperidine and 2-butoxyethylacrylate (molar ratio: 40:60)
(20) Copolymer of N-(1,1-dimethyl-3-hydroxybutyl-)acrylamide and 2-ethylhexylmethacrylate (molar ratio: 65:35)
(21) Copolymer of N-acryloylpiperidine and butylacrylate (molar ratio: 50:50)
(22) Copolymer of N-(p-hydroxyphenyl)acrylamide and butylacrylate (molar ratio: 20:80)
(23) Copolymer of N-[3-(dimethylaminopropyl)-propyl]-acrylamide and butylacrylate (molar ratio: 30:70)
(24) Copolymer of N-methyl-N'-methacryloylpiperazine and 2-ethoxyethylacrylate (molar ratio: 30:70)
(25) Copolymer of 2,6-dimethyl-4-methacryloylmorpholine and butylacrylate (molar ratio: 50:50)
(26) Copolymer of N-tert-butylacrylamide, butylacrylate and 2-ethoxyethylacrylate (molar ratio: 45:30:25)
(27) Copolymer of N-(1,1-dimethyl-3-oxobutyl)acrylamide, butylacrylate and N,N-diethylacrylamide (molar ratio: 40:40:20)
(28) Copolymer of N-methyl-N'-methacryloylpiperazine, 2-ethoxybutylacrylate and ethylacrylate (molar ratio: 30:40:30)
(29) Copolymer of N-methyl-N-benzylacrylamide, butylacrylate and dibutyl fumarate (molar ratio: 30:60:10)

Also, specific examples of typical polymers having therein the recurring unit represented by the general formula (II) are illustrated as follows.

(30) Poly(N-vinylpyrrolidone)
(31) Poly(N-vinyloxazolidone)
(32) Poly(N-vinylsuccinimide)
(33)Poly(N-vinylglutarimide)
(34) Poly(N-vinylpiperidone)
(35) Poly(N-vinyl-ε-caprolactam)
(36) Poly(N-methyl-N-vinylacetamide)
(37) Poly(N-ethyl-N-vinylacetamide)
(38) Poly(vinyl alcohol)
(39) Copolymer of vinyl alcohol and vinyl acetate (molar ratio: 80:20)
(40) Copolymer of vinyl alcohol and vinyl acetate (molar ratio: 88:12)
(41) Copolymer of vinyl alcohol and N-vinylpyrrolidone (molar ratio: 30:70)
(42) Copolymer of N-vinylpyrrolidone and vinyl acetate (molar ratio: 70:30)
(43) Copolymer of N-vinylpyrrolidone and 2-hydroxyethylacrylate (molar ratio: 80:20)
(44) Copolymer of N-vinylpyrrolidone and acrylic acid (molar ratio: 90:10)
(45) Copolymer of N-vinylpyrrolidone and N-vinyl-3,5-dimethyltriazole (molar ratio: 50:50)
(46) Copolymer of N-vinylpiperidone and 2-methoxyethylacrylate (molar ratio: 70:30)
(47) Copolymer of N-vinylpiperidone and methyl vinyl ether (molar ratio: 90:10)
(48) Copolymer of N-vinyloxazolidone and vinyl alcohol (molar ratio: 65:35)

(49) Copolymer of N-vinyloxazolidone and acrylic acid (molar ratio: 80:20)

(50) Copolymer of N-vinylpyrrolidone, N-vinylpiperidone and 2-hydroxyethylacrylate (molar ratio: 40:30:30)

(51) Copolymer of vinyl alcohol, vinyl acetate and N-vinyl-2-pyridone (molar ratio: 70:25:5)

(52) Copolymer of N-vinylpyrrolidone, 2-hydroxyethylacrylate and vinyl acetate (molar ratio: 70:20:10)

(53) Copolymer of N-vinylpyrrolidone, vinyl alcohol, vinyl propionate and sodium styrene sulfonate (molar ratio: 40:40:5:15)

Further, the polymers having therein the recurring unit represented by the general formula (II) can be the polymers shwon in the following.

(54) Copolymer of N-vinylpyrrolidone and acrylamide (molar ratio: 60:40)

(55) Copolymer of N-vinylpyrrolidone and 2-acrylamido-2-methylpropane sulfonic acid (molar ratio: 75:25)

(56) Copolymer of N-vinylpiperidone and acrylamide (molar ratio: 60:40)

(57) Copolymer of N-vinyloxazolidone and N-(2-hydroxyethyl)-acrylamide (molar ratio: 70:30)

(58) Copolymer of N-vinylpyrrolidone, V-vinylmorpholine and acrylamide (molar ratio: 50:20:30)

(59) Copolymer of N-vinylsuccinimide, N-vinyl-ε-caprolactam and acrylamide (molar ratio: 40:20:40)

(60) Copolymer of N-vinyloxazolidone, acrylamide and acrylic acid (molar ratio: 60:20:20)

(61) Copolymer of N-vinylpyrrolidone, acrylamide, vinyl acetate and acrylic acid (molar ratio: 60:20:10:10)

(62) Copolymer of N-vinylpyrrolidone and dimethylacrylamide (molar ratio: 70:30)

The polymer having therein the recurring unit represented by the general formula (I) of the present invention is a hydrophobic polymer and is soluble in or miscible with an organic solvent, for example, methyl acetate, ethyl acetate, butyl acetate, methyl isobutyl ketone, β-ethoxyethylacetate, methylcarbitol, dioxane, cyclohexane, cyclohexanone, dipropylene glycol, N,N-dimethylformamide, propanol, isopropanol, methanol, butanol, sec-butanol, ethylene glycol monomethyl ether, ethylene glycol monobutyl ether, etc. Therefore, the polymer can be dispersed in a hydrophilic colloid layer of a silver halide color light-sensitive material by dissolving the polymer in such a solvent. In order to disperse the polymer, an organic solvent having a boiling point of about 180° C. or more can be used which is conventionally used for dispersing a hydrophobic coupler, for example, an ester of an inorganic acid, for example, a phosphoric acid ester such as tricresyl phosphate, etc.; an aliphatic organic acid ester such as acetyl tributyl citrate, etc.; an aromatic organic acid ester, for example, a phthalic acid ester such as dibutyl phthalate, etc.; a benzoic acid ester such as octyl benzoate, etc.; an aliphatic amide such as N,N-diethyllaurylamide, etc. An anionic surface active agent, for example, those described in Japanese Patent Publications 4293/1964 and 4547/1971, U.S. Pat. Nos. 2,322,027, 2,360,289, 2,801,170, 2,801,171, 2,852,382, 2,949,360, 3,396,027 and 3,619,195, German Pat. Nos. 1,143,707, 2,045,414, 2,043,271, and 2,045,464, Japanese Pat. applications (OPI) 66230/1975, etc., or an amphoteric surface active agent, such as N,N-dimethyl-N-dodecylbetaine, N-tetradecyl N,N-dipolyethylene-α-betaine, etc., can be advantageously used as a dispersing aid. Furthermore, a nonionic surface agent can be used together therewith, for example, as described in German Pat. No. 1,942,873, etc.

To disperse the polymer, the methods as described, for example, in U.S. Pat. Nos. 2,304,939, 2,322,027, 2,801,170, 2,801,171 and 2,949,360 can be used.

The polymer having therein the recurring unit represented by the general formula (I) can be dispersed separately from a hydrophobic coupler in a silver halide emulsion. However, it is advantageous for obtaining the effects of the present invention for the polymer to be dispersed in a hydrophilic colloid together with a hydrophobic coupler and then added to a silver halide emulsion.

The polymer having therein the recurring unit represented by the general formula (II) is a polymer having a relatively high hydrophilic property, and it is advantageous for obtaining the effects of the present invention for an aqueous solution thereof or a water miscible organic solvent solution thereof to be mixed with a hydrophilic colloid of a silver halide emulsion layer or another layer which forms the photographic light-sensitive material. Further, the polymer can be dissolved in an organic solvent and dispersed in a hydrophilic colloid separately or together with the polymer having therein the recurring unit represented by the general formula (I). However, it is undesirable to disperse the polymer together with a hydrophobic coupler, that is, for both to be included in the same dispersed phase. In this case, as the organic solvent, those described with respect to the polymer having therein the recurring unit represented by the general formula (I) can be used.

The polymer having therein the recurring unit represented by the general formula (I) according to the present invention is used in an amount of about 0.1 to about 3 g, preferably 0.2 to 2 g per g of coupler and in a weight ratio to a hydrophobic coupler of about 20:1 to about 0.01:1, preferably 1:1 to 0.05:1. The polymer having therein the recurring unit represented by the general formula (II) is used in an amount of about 0.05 to about 1 g, preferably 0.1 to 0.5 g per g of coupler and in a weight ratio to a hydrophobic coupler of about 10:1 to about 0.01:1, preferably 2.5:1 to 0.05:1.

Examples of the hydrophobic coupler which can be used in the light-sensitive material of the present invention includes, for example, a 5-pyrazolone coupler, a cyanoacetylcumarone coupler, an indazolone coupler, a benzimidazolopyrazolone coupler, an open-chain acylacetonitrile coupler, an open-chain acrylacetamide coupler (especially, a benzoylacetanilide compound and a pivaloylacetanilide compound), a malondianilide compound, a naphthol coupler, a phenol coupler, and the like.

As a magenta coupler, the compound represented by the following general formula (III) is useful:

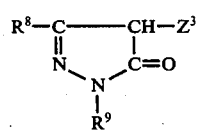

(III)

wherein $R^8$ represents a primary, secondary or tertiary alkyl group (such as methyl, ethyl, propyl, n-butyl, tertbutyl, hexyl, 2-hydroxyethyl, 2-phenylethyl, etc.), an aryl group; a heterocyclic group (such as a 5-membered or 6-membered ring contaning one or more of a nitrogen atom, an oxygen atom, etc., as a hetero atom, and more specifically, quinolynyl, pyridyl, benzofuranyl, oxazolyl, etc.); an amino group (such as methylamino, diethylamino, dibutylamino, phenylamino, tolylamino, 4-(3-sulfobenzamino)anilino, 2-chloro-5-acylaminoanilino, 2-chloro-5-alkoxycarbonylanilino, 2-trifluoromethylphenylamino, etc.); a carbonamido group (such as alkylcarbonamido, e.g., ethylcarbonamido, etc., arylcarbonamido, heterocyclic carbonamido, e.g., benzothiazolylcarbonamido, etc., etc.); a sulfonamido group (such as unsubstituted sulfonamido, alkylsulfonamido, arylsulfonamido, heterocyclic sulfonamido, etc.); a ureido group (such as alkylureido, arylureido, heterocyclic ureido, etc.); an alkoxy group (such as methoxy, ethoxy, etc.); and the like. $R^9$ represents a hydrogen atom; an aryl group (such as naphthyl, phenyl, 2,4,6-trichlorophenyl, 2-chloro-4,6-dimethylphenyl, 2,6-dichloro-4-methoxyphenyl, 4-methylphenyl, 4-acylaminophenyl, 4-alkylaminophenyl, 4-trichloromethylphenyl, 3,5-dibromophenyl, etc.); a heterocyclic group (such as a 5-membered or 6-membered ring containing one or more of a nitrogen atom, an oxygen atom, etc., as a hetero atom, and more specifically, benzofuranyl, naphthoxazolyl, quinolinyl, etc.); an alkyl group (such as ethyl, benzyl, etc.), and the like. $Z^3$ represents a group capable of splitting off upon color development, such as an acyloxy group, an aryloxy group, a heterocyclic oxy group, a halogen atom, a thiocyano group, a disubstituted amino group, a carbonamido group, a dioxopyrrolidinyl group, a dioxoimidazolidinyl group, a dioxooxazolidinyl group, dioxothiazolidinyl group, a sulfonamido group, a aryloxycarbonyloxy group, an alkoxycarbonyloxy group, a benzotriazolyl group, an indazolyl group, a arylazo group or a heterocylic azo group, etc. Examples of these groups are described in U. S. Pat. Nos. 3,227,550, 3,252,924, 3,311,476 and 3,419,391, German Pat. application (OLS) 2,015,867, Japanese Pat. application (OPI) 13041/1975, etc. Also, $Z^3$ represents a group capable of releasing a development inhibitor upon development, for example, an arylmonothio group (such as a 2-aminophenylthio group, a 2-hydroxycarbonylphenylthio group, etc.), a heterocyclic monothio group (such as a tetrazolylthio group, a triazinylthio group, a triazolylthio group, an oxazolylthio group, an oxadiazolylthio group, a diazolylthio group, a thiazolylthio group, a thiadiazolylthio group, etc.), a heterocyclic imido group (such as a 1-benzotriazolyl group, a 1-indazolyl group, a 2-benzotriazolyl group, etc.), and the like, and described, for example, in U.S. Pat. Nos. 3,148,062, 3,227,554, 3,615,506 and 3,701,783, Japanese Pat. application (OPI) 122335/1974, etc.

As a yellow coupler, the compound represented by the following general formula (IV) is useful.

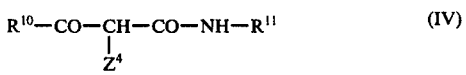

(IV)

wherein $R^{10}$ represents a primary, secondary or tertiary alkyl group containing 1 to 18 carbon atoms (such as tertbutyl, 1,1-dimethylpropyl, 1,1-dimethyl-1-methoxyphenoxymethyl, 1,1-dimethyl-1-ethylthiomethyl, 1,1-dimethyl-1-ethylthiomethyl, etc.); an aryl group (such as phenyl, alkylphenyl, e.g., 3-methylphenyl, 3-octadecylphenyl, etc., alkoxyphenyl, e.g., 2-methoxyphenyl, 4-methoxyphenyl, etc., halophenyl, 2-halo-5-alkamidophenyl, 2-chloro-5-[α-(2,4-ditert-amylphenoxy)butyramido]phenyl, 2-methoxy-5-alkamidophenyl, 2-chloro-5-sulfonamidophenyl, etc.); an amino group (such as anilino, p-methoxyanilino, butylamino, etc.). $R^{11}$ represents an aryl group (such as 2-chlorophenyl, 2-halo-5-alkamidophenyl, 2-chloro-5-[α-(2,4-di-tert-amylphenoxy)-acetamido]phenyl, 2-chloro-5-(4-methylphenylsulfonamido)-phenyl, 2-methoxy-5-(2,4-di-tert-amylphenoxy)acetamidophenyl, etc.). Examples of the above-described halogen atom include, for example, fluorine, chlorine, bromine, etc. $Z^4$ represents a group capable of splitting off upon color development, such as a halogen atom (especially a fluorine atom), an acyloxy group, an aryloxy group, a hetereoaromatic carbonyloxy group, a sulfimido group, an alkylsulfoxy group, an arylsulfoxy group, a phthalimido group, a dioxoimidazolidinyl group, a dioxooxazolidinyl group, an indazolyl group, a dioxothiazolidinyl group, etc. Particularly, a coupler having a releasing group bonded through an imino group is useful. These groups are described, for example, in U.S. Pat. Nos. 3,227,550, 3,253,924, 3,227,155, 3,265,506, 3,408,194 and 3,415,652, French Pat. No. 1,411,384, British Pat. Nos. 944,490, 1,040,710 and 1,118,028, German Pat. applications (OLS) 2,057,941, 2,163,812, 2,213,461 and 2,219,971, etc., and $Z^4$ also represents a group capable of releasing a development inhibitor, for example, an arylmonothio group (such as phenylthio group, 2-carboxyphenylthio grop, etc.), a heterocyclic thio group, a 1-benzotriazole group, a 1-benzodiazole group, especially a group as described in Japanese Pat. application (OPI) 122335/1974, U.S. Pat. No. 3,227,554, etc.

A cyan coupler includes, for example, a naphthol coupler and a phenol coupler. Particularly, the compound represented by the following general formula (V) or (VI) is useful.

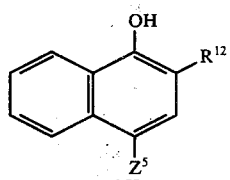

(V)

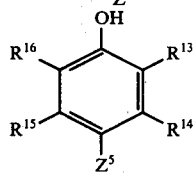

(VI)

wherein $R^{12}$ represents a substituent which is conventionally used in a cyan coupler, for example, a carbamyl group (such as an alkyl carbamyl group, a phenylcarbamyl group, a heterocyclic carbamyl group such as benzothiazolylcarbamyl, etc.), a sulfamyl group (such as an alkylsulfamyl group, a phenylsulfamyl group, a heterocyclic sulfamyl group, etc.), an alkoxycarbonyl group or an aryloxycarbonyl group; $R^{13}$ represents an alkyl group, an aryl group, a heterocyclic group, an amino group (such as an amino group, an alkylamino group, an arylamino group, etc.), a carbonamido group (such as an alkylcarbonamido group, an arylcarbonamido group, etc.), a sulfamido group, a sulfamyl group (such as an alkylsulfamyl group, an arylsulfamyl group, etc.), a carbamyl group, and the like; $R^{14}$, $R^{15}$ and $R^{16}$ each represents a group as defined with respect to $R^{13}$, and further a halogen atom, an alkoxy group, etc.; $Z^5$ represents a group capable of splitting off upon color development, such as, for example, a halogen atom (such as a chlorine atom, a bromine atom, an iodine atom, etc.), an indazolyl group, a cyclic imido group, an acyloxy group, an aryloxy group, an alkoxy group, a sulfo group, an arylazo group, a heterocyclic azo group, a heterocyclic group, a heterocyclic thio group, etc. Examples of these groups are described in U.S. Pat. Nos. 2,423,730, 3,227,550 and 3,311,476, British Pat. Nos. 1,084,480 and 1,165,563, etc.

Further, it is also known that, in addition to the above-described yellow, magenta and cyan couplers, a development inhibitor releasing compound can be used to obtain a photographic material which has extremely superior graininess, sharpness and color reproduction. These compounds are described, for example, in Japanese Pat. application (OPI) 129536/1974, U.S. Pat. Nos. 3,379,529, etc. The coupler used in the present invention can be a colored coupler. Examples of suitable colored couplers are described, for example, in U.S. Pat. Nos. 2,983,608, 3,005,712, 3,034,892, British Pat. Nos. 936,621, 1,269,073, 586,211 and 627,814, French Pat. Nos. 980,372, 1,091,903, 1,257,887, 1,398,308 and 2,015,649, etc.

For the coupler used in the present invention it is advantageous for the coupler to be rendered diffusion resistant. In order to render a coupler diffusion resistant, a group having a hydrophobic residue containing 8 to 32 carbon atoms is introduced into the coupler molecule. Such a residue is usually called a "ballast group." The ballast group can be linked to the skeleton of the coupler molecule directly or through an imino bond, an ether bond, a carbonamido bond, a sulfonamido bond, a ureido bond, an ester bond, an imido bond, a carbamoyl bond, or a sulfamoyl bond. In the case of a two-equivalent coupler, the ballast group can be linked to a group capable of being split off on develoment. Some typical examples of ballast groups are shown in the specific examples of the couplers used in the present invention.

Specific examples of the couplers which can be used in the present invention are illustrated below, but it should be noted that the present invention is not to be construed as being limited to these couplers.

(101) α-Acetoxy-α-3-[γ-(2,4-di-tert-amylphenoxy)-butyramido]-benzoyl-2-methoxyacetanilide (102) α-(2,4-Dioxo-5,5-dimethyloxazolidinyl)-α-pyvaloyl-2-chloro-5-[α-(2,4-di-tert-amylphenoxy)-butyramido]-acetanilide (103) α-(4-Carboxyphenoxy)-α-pivaloyl-2-chloro-5-[α-(2,4-di-tert-amylphenoxy)butyramido]acetanilide (104) α-(5- or 6-Methyl-1-benzotriazolyl)-α-N-4-methoxyphenylcarbamoyl-2-methoxy-5-[α-(2,4-di-tert-amylphenoxy)butyramido]acetanilide (105) α-Benzoyl-α-(2-benzothiazolylthio)-4-[N-(γ-phenylpropyl)-N-(4-tolyl)sulfamyl]acetanilide (106) α-Pivaloyl-α-(5- or 6-bromo-1-benzotriazolyl)-5-[α-(2,4-di-tert-amylphenoxy)propionamido]-2-chloroacetanilide (107) α-(N-Benzyl-5-ethoxyhydantoinyl)-α-(4-methoxybenzoyl)-2-chloro-5-[α-(2,4-di-tert-amylphenoxy)butyramido]-acetanilide (108) 1-(2,4,6-Trichlorophenyl)-3-{3-[α-(2,4-di-tertamylphenoxy)acetamido]benzamido}-4-acetoxy-5-pyrazolone (109) 1-(2,4,6-Trichlorophenyl)-3-tridecylamido-4-(4-hydroxyphenyl)azo-5-pyrazolone (110) 1-(2,4,6-Trichlorophenyl)-3-(3-tetradecyloxycarbonyl-6-chloro)anilino-4-(1-naphthylazo)-5-pyrazolone (111) 1-(2,4-Dichloro-6-methoxyphenyl)-3-[(3-tridecanoylamino-6-chloro)anilino]-4-benzyloxycarbonyloxy-5-pyrazolone (112) 1-{4-[γ-(2,4-Di-tert-amylphenoxy)butyramido]-phenyl}-3-piperidinyl-4-(1-phenyl-5-tetrazolylthio)-5-pyrazolone (113) 1-Benzyl-3-{4-[α-(2,4-di-tert-amylphenoxy)-butyramido]-anilino}-4-(5- or 6-bromo-1-benzotriazolyl)-5-pyrazolone (114) 1-{4-[α-(2,4-di-tert-amylphenoxy)acetamido]-phenyl}-3-ethoxy-4-(5- or 6-bromo-p-benzotriazolyl)-5-pyrazolone (115) 1-(2,4,6-Trichlorophenyl)-3-{3-[(2,4-di-tertamylphenoxy)acetamido]benzamido}-4-benzenesulfonamido-5-pyrazolone (116) 1-Hydroxy-4-thiocyano-N-[γ-(2,4-di-tert-amylphenoxy)-propyl]-2-naphthamide (117) 1-Hydroxy-4-[2-(2hexyldecyloxycarbonyl)-phenylazo]-N-(1-naphthyl)-2-naphthamide (118) 1-Hydroxy-4-chloro-N-[α-(2,4-di-tert-amylphenoxy)-butyl]-2-naphthamide (119) 5-Methyl-4,6-dichloro-2-[α-(3-n-pentadecylphenoxy)-butyramido]phenol (120 ) 1-Hydroxy-4-iodo-N-dodecyl-2-naphthamide (121) 5-Methoxy-2-[α-(3-n-pentadecylphenoxy)-butyramido]-4-(1-phenyl-5-tetrazolylthio)phenol (122) N-[α-(2,4-Di-tert-amylphenoxy)acetyl]-ω-(1-phenyl-5-tetrazolylthio)-m-aminoacetophenone (123) α-Stearyloxybenzoyl-α-[5- or 6-(N-methylbenzothiazolideneamino)-1-benzotriazolyl]-2-ethoxyacetanilide (124) 1-(2,4,6-Trichlorophenyl)-3-[(2-chloro-5-tetradecanamido)anilino]-4-(5- or 6-acetamido-1-benzotriazolyl)-5-pyrazolone Development inhibitor releasing compounds which can be used together with the above-described couplers include:

(125) 2-n-Dodecylthio-(1'-phenyl-5-tetrazolylthio)-hydroquinone (126) [5- or 6-(N-Methylbenzothiazolidineamino)-1-benzotriazolyl]-N-(2,2'-dichloro-5,5'-didodecyloxycarbonyl)phenyl malonic diamide (127) α-(2-Benzoxazolyl)-α-(1-phenyl-5-tetrazolylthio)-2-chloro-5-hexadecyloxycarbonylacetanilide In the light-sensitive material of the present invention, a fading preventing agent for the developed color image as described in Belgian Pat. 777,487, German Pat. No. 1,547,684, German Pat. application (OLS) 2,146,668, etc., and a phenol derivative or a hydroquinone derivative or a precursor thereof, as described in U.S. Pat. Nos. 2,336,327, 2,728,659, 2,835,579 and 3,700,453, Japanese Pat. application (OPI) 23823/1975, etc., can be used.

In the light-sensitive material of the present invention, as a silver halide emulsion, those containing silver bromide, silver iodide, silver chloride or a mixture thereof, such as silver chlorobromide, silver iodobromide, and silver chloroiodobromide can be used, although good results are obtained when at least one photographic emulsion layer comprises a silver chloroiodide, silver iodobromide or silver chloroiodobromide with an iodide content of about 1 to about 10 mol%. The weight ratio of silver to the hydrophilic colloid binder employed preferably ranges between about 0.1:1 to about 7:1, more desirably 0.4:1 to 1:1. As the hydrophilic colloid binder, gelatin, a cellulose derivative, e.g., methyl cellulose, an alginate and a hydrophilic synthetic polymer, such as a hydroxyalkyl acrylate or a homolog thereof, polystyrenesulfonic acid, etc., can be suitably used and a plasticizer and a polymer latex, such as of polymethylmethacrylate and polyethylacrylate, a latex as described in Japanese Pat. Publication 5331/1970 can be also used for improving dimensional stability.

Conventional chemical sensitizing processes, for example, a gold sensitizing process as described in U.S. Pat. No. 2,399,083, a reduction sensitizing process as described in U.S. Pat. Nos. 2,487,850 and 2,518,698, a sulfur sensitizing process as described in U.S. Pat. Nos. 1,623,499 and 1,574,944, and a sensitizing method using a metallic ion of VIII group as described in U.S. Pat. No. 2,448,060 can be applied to the silver halide emulsion used in the present invention. Further, the silver halide photographic emulsion used in the present invention can be spectrally sensitized using a sensitizing dye which is conventionally used in a color light-sensitive material, individually or in combination.

Furthermore, the light-sensitive material of the present invention can contain in a silver halide emulsion layer or other hydrophilic colloid layer thereof a conventional stabilizer such as a 4-hydroxy-1,3,3a,7-tetrazaindene derivative; an anti-fogging agent such as a mercapto compound (such as 1-phenyl-5-mercaptotetrazole) and a benzotriazole derivative; a coating aid such as saponin, sodium alkylbenzenesulfonate, an acylated taurine, a surface active agent as described in U.S. Pat. No. 3,415,649, British Pat. Nos. 1,012,495 and 1,077,317; a wetting agent; a sensitizing agent such as a polyalkylene oxide derivative as described in U.S. Pat. Nos. 2,708,162, 2,531,832, 2,533,990, 3,210,191 and 3,158,484; and an irradiation preventing dye such as a dye described in Japanese Pat. applications (OPI) 85130/1973 and 114420/1974, and the like.

The photographic light-sensitive material of the present invention can contain an inorganic or organic hardening agent in a photographic emulsion layer or other hydrophilic colloid layer. For instance, a chromium salt (such as chromium alum, chromium acetate, etc.), an aldehyde (such as formaldehyde, glyoxal, glutaraldehyde, etc.), an N-methylol compound (such as dimethylol urea, methylol dimethylhydantoin, etc.), a dioxane derivative (such as 2,3-dihydroxydioxane, etc.), an active vinyl compound (such as 1,3,5-triacryloylhexahydro-s-triazine, bis(vinylsulfonyl)-methyl ether, etc.), an active halogen compound (such as 2,4-dichloro-6-hydroxy-s-triazine, etc.), a mucohalic acid (such as mucochloric acid, mucophenoxychloric acid, etc.), an isoxazole, a dialdehyde starch, a 2-chloro-6-hydroxytriazinylated gelatin, and the like, individually or in combination. Specific examples of suitable hardening agents are described in U.S. Pat. Nos. 1,870,354, 2,080,019, 2,726,162, 2,983,611, 2,992,109, 3,047,394, 3,057,723, 3,103,437, 3,321,313, 3,325,287, 3,362,827, 3,380,829, 3,539,644 and 3,543,292, British Pat. Nos. 676,828, 825,544 and 1,270,578, German Pat. Nos. 872,153 and 1,090,427, Japanese Pat. Publication 7133/1959, Belgian Pat. No. 725,964, etc.

The light-sensitive emulsion used in the present invention can be applied to various supports, for example, a cellulose acetate film, a polyethylene terephthalate film, a polypropylene film, a baryta paper, an $\alpha$-olefinic polymer-laminated paper, a synthetic paper, etc., in an amount of about 10 to about 1,000 $\mu g/cm^2$. In color development of the color photographic light-sensitive material in accordance with the present invention, a developing solution containing as a developing agent a para-phenylenediamine derivative, such as 4-amino-N,N-diethylaniline, 4-amino-3-methyl-N-methyl-N-($\beta$-methylsulfonamidoethyl)aniline, 4-amino-3-methyl-N-ethyl-N-($\beta$-hydroxyethyl)aniline, 4-hydroxyaniline, 4-hydroxy-2,6-dibromoaniline, etc., can be used.

The photographic light-sensitive material of the present invention can be exposed according to methods described, e.g., in C. E. K. Mees & T. H. James: The Theory of the Photographic Process, 3rd Ed., Macmillan, New York, pp. 410–416.

The photographic light-sensitive material in accordance with the present invention can be processed at ordinary processing temperatures, that is, at about 20° to about 30° C., and at higher temperatures, that is, at about 30° to 60° C. or higher.

The color photographic light-sensitive material of the present invention can conveniently be processed in the manner described in, for example, Japanese Pat. Publication 35749/1970, U.S. Pat. No. 3,695,883, British Pat. No. 1,387,713, H. Gordon, The British Journal of Photography, pp. 558 — (Nov. 15, 1954), ibid., pp. 440 — (Sept. 9, 1955) and ibid., pp. 2 — (Jan. 6, 1956), S. Horwitz, ibid., pp. 212 — (Apr. 22, 1960), E. Gehret, ibid., pp. 122 — (Mar. 4, 1960) and pp. 396 — (May 7, 1965) and J. Meech, ibid., pp. 182 — (Apr. 3, 1959), German Pat. application (OLS) 2,238,051, etc.

The primary processing steps include, fundamentally, color development, bleaching and fixing. In this case, each step may be carried out individually, or two or more steps may be carried out at one time by using processing solutions having multiple capabilities, e.g., a blix bath may be taken as an example of such a bath. Furthermore, each step may be carried out two or more times separately, or a combined color development, first fixing and a blixing is possible. As desired, the developing processing may further include various conventional steps such as a preliminary hardening, a neutralizing, a first development (black-and-white development), an image stabilizing, washing, etc.

Color developing agents are those compounds whose oxidation products react with color couplers, thereby producing a colored dye product, that is, an aqueous alkali solution containing one or more developing agents and having a pH of about 8 or more, preferably 9 to 12.

Various additives can be added to the color developer, if desired. Such additives are conventional and include alkali agents such as alkali metal hydroxides, carbonates, and phosphate ammonium salts; pH controlling agents or buffers such as weak acids, e.g., acetic acid and boric acid, and weak bases, and salts thereof; development accelerating agents such as pyrizinium compounds and cationic compounds as described in U.S. Pat. Nos. 2,648,604, 3,671,247, etc., potassium nitrate and sodium nitrate, polyethylene glycol condensates and derivatives thereof as described in U.S. Pat. Nos. 2,533,990, 2,577,127, 2,950,970, etc., nonionic compounds such as polythioethers and the like, typical examples of which are described in British Pat. Nos. 1,020,033 and 1,020,032, polymer compounds containing a sulfite ester group therein, typical examples of which are described in U.S. Pat. No. 3,068,097, and in addition, organic amines such as pyridine, ethanolamine, and the like, benzyl alcohol, hydrazines, etc., anti-fogging agents such as alkali metal bromides, alkali metal iodides, and nitrobenzoimidazoles as described in U.S. Pat. Nos. 2,496,940, 2,656,271, mercaptobenzoimidazole, 5-methylbenzotriazole, 1-phenyl-5-mercaptotetrazole, compounds for rapid processing solutions as described in U.S. Pat. Nos. 3,113,864, 3,342,596, 3,295,976, 3,615,522, 3,597,199, etc., thiosulfonyl compounds as described in British Pat. No. 972,211, phenazine-N-oxides as described in Japanese Pat. Publication 41675/1971, and fog-controlling agents as described in Kagaku Shashin Binran, Volume II, pages 29 to 47, etc., and in addition, stain or sludge-preventing agents as described in U.S. Pat. Nos. 3,161,513, 3,161,514, British Pat. Nos. 1,030,442, 1,144,481, 1,251,558, etc., interimage effect accelerating agents as described in U.S. Pat. No. 3,536,487, preservatives such as sulfites, bisulfites, hydroxylamine hydrochloride, formaldehyde-sulfite adducts or alkanolamine sulfite adducts.

Fixing solutions are used to remove soluble silver salts from photographic materials. As fixing agents, any of those compounds generally used as solvents for silver halides in the photographic arts can be used. For example, fixing solutions containing water-soluble thiosulfates (e.g., sodium thiosulfate, potassium thiosulfate, ammonium thiosulfate, and the like), water-soluble thiocyaniates (e.g., sodium thiocyanate, potassium thiocyanate, ammonium thiocyanate, and the like), water-soluble oxygen- or sulfur-containing organic diols (e.g., 3-thia-1,5-pentandiol, 3,6-dithia-1,8-octandiol, 9-hexa-3,6,12,15-tetrathia-1,17-heptadecandiol, and the like), water-soluble sulfur-containing dibasic acids, and water-soluble salts thereof (e.g., ethylene bisthioglycolic acid and the sodium salt thereof, and the like), imidazolizinethione(methylimidazolizinethione and the like), etc., can be advantageously used.

In addition, those fixing agents described in L. F. A. Mason, Photographic Processing Chemistry, pages 187 to 188, Focal Press (1966) can be advantageously used.

In the case of reversal processing steps, the methods as described in U.S. Pat. Nos. 2,994,900 (col. 11 to 12), 2,984,567 (col. 3 to 7) and 3,189,452 (col. 9 to 10), etc., can be used.

After color development, the photographic emulsion layer is bleached using a conventional process. The bleaching can be carried out concurrently with or separately from fixing. As the bleaching agent, for example, a polyvalent metallic compound such as an iron (III), cobalt (III), chromium (VI), copper (II), etc., compound, a peracid, a quinone, a nitroso compound, etc., can be used. For example, a ferricyanate, a bichromate, a complex salt of iron (III) or cobalt (III) with an organic acid, for example, an aminopolycarboxylic acid such as ethylenediamine tetraacetic acid, nitrilotriacetic acid, 1,3-diamino-2-propanol tetraacetic acid, etc., an organic acid such as citric acid, tartaric acid, malic acid, etc., a persulfate, a permanganate, a nitrosophenol, etc. can be used. Of these, potassium ferricyanate, sodium iron (III) ethylenediamine tetraacetate and ammonium iron (III) ethylenediamine tetraacetate are particularly useful. The complex salt of iron (III) with ethylenediamine tetraacetic acid is useful both in an individual bleaching solution and in a mono-bath bleach-fixing solution. A bleaching promotor, as described in U.S. Pat. Nos. 3,042,520 and 3,241,966, Japanese Pat. Publications 8506/1970 and 8836/1970, and other various conventional additives can be added to the bleaching solution and the bleach-fixing solution.

The photographic light-sensitive material in accordance with the present invention can be bleached by means of a bleaching solution exhibiting an oxidation-reduction potential (E redox), as defined hereinafter, of about −150 mV to about 1,000 mV and containing a halide ion and a metallic salt or an organic oxidizing agent. Examples of suitable metallic salts include a salt of a transition metal, especially a salt or a complex salt of $Ti^{4+}$, $V^{5+}$, $Cr^{6+}$, $Mn^{7+}$, $Mn^{3+}$, $Cu^{2+}$, $Fe^{3+}$ and $Co^{3+}$, and the organic oxidizing agent preferably includes, for example, p-sulfophenylquinone, sulfonaphthoquinones, Wurster's blue radical and Weitz radical. Specific compounds are described, for example, in U.S. Pat. Nos. 2,507,183, 2,529,981, 2,625,477, 2,748,000, 2,810,648 and 2,705,201, British Pat. Nos. 1,111,313, 777,635, 1,032,024, 1,014,396 and 982,984 and Japanese Pat. Publications 14035/1970 and 13944/1971.

The "E redox" as described above is defined as the value determined by means of a composite platinum electrode, EA-216 manufactured by Metrohm, Ltd., combined with a silver/silver chloride electrode as a reference electrode and a potentiometer, E-436 manufactured by Metrohm, Ltd.

The invention will be further illustrated in greater detail with reference to the following examples, but these are not to be construed as limiting the invention. Unless otherwise indicated herein, all parts, percents, ratios and the like are by weight.

EXAMPLE 1

A solution prepared by heating at 50° C. a mixture of 40 g of the above-described Coupler (102), i.e., α(2,4-dioxo-5,5-dimethyloxazolidinyl)-α-pivaloyl-2-chloro-5-[α-(2,4-di-tert-amylphenoxy)butyramido]acetanilide, 20 ml of di-n-butyl phthalate and 80 ml of ethyl acetate was added to 400 ml of an aqueous solution containing 40 g of gelatin and 2.0 g of sodium p-dodecylbenzene sulfonate. The mixture was stirred vigorously and then passed seven times through a preheated colloid mill. The coupler was finely dispersed together with the solvent.

140 g of the dispersion was added to 200 g of a silver iodobromide emulsion (containing 2 mol% iodide, $6 \times 10^{-2}$ mol of silver and 15 g of gelatin) and 15 ml of a 4% aqueous solution of 2-hydroxy-4,6-dichloro-s-triazine sodium salt was added thereto as a hardener. The pH of the mixture was adjusted to 6.5 and the mixture was coated on a cellulose triacetate film support in a coated silver amount of 0.70 g/m$^2$. This was designated Sample (A).

Sample (B) was prepared in the same manner as Sample (A) except for using 4 ml of di-n-butyl phthalate, 60 ml of ethyl acetate and 32 g of a 50% by weight ethyl acetate solution of the above-described Polymer (10) according to the present invention, i.e., a copolymer of N-(1,1-dimethyl-3-oxobutyl)acrylamide and butylacrylate (molar ratio: 40:60) having a molecular weight of 12,000 in the coupler dispersion.

A third sample was prepared by adding 40 ml of a 2% aqueous solution of the above-described Polymer (40), i.e., a copolymer of vinyl alcohol and vinyl acetate (molar ratio: 88:12) having a molecular weight of 110,000 to a coating solution the same as used in Sample (A). This was designated Sample (C).

Further, another sample was prepared by using a dispersion the same as used in Sample (B) and adding 40 ml of a 2% aqueous solution of a copolymer of vinyl alcohol and vinyl acetate (the above-described Polymer (40)) the same as used in Sample (C). This was designated Sample (D).

The average particle sizes of the oil droplets in the dispersion used for the preparation of Samples (A) to (D) were measured using a light scattering method and the results as set forth below were obtained.

| | Average Particle Size (μ) |
|---|---|
| Dispersion used in Samples (A) and (C) | 0.18 |
| Dispersion used in Samples (B) and (D) | 0.16 |

These samples were subjected to stepwise exposure (500 CMS at a color temperature of 3,200° K.) followed by processing in the following manner.

| Processing Step | Temperature (° C) | Time (seconds) |
|---|---|---|
| 1. Color Development | 32 | 240 |
| 2. Water Washing | 32 | 5 |
| 3. First Fixing | 32 | 30 |
| 4. Water Washing | 32 | 120 |
| 5. Bleaching | 32 | 60 |
| 6. Water Washing | 32 | 60 |
| 7. Second Fixing | 32 | 90 |
| 8. Water Washing | 32 | 90 |
| 9. Drying | | |

The compositions of the processing solutions used were as follows.

| | | |
|---|---|---|
| Color Developer Solution | | |
| Sodium Sulfite | 2 | g |
| 4-Amino-3-methyl-N,N-diethylaniline Hydrochloride | 1.5 | g |
| Sodium Carbonate (monohydrate) | 60 | g |
| Potassium Bromide | 1 | g |
| Hydroxylamine Hydrochloride | 0.6 | g |
| Water to make | 1,000 | ml |
| First Fixing Solution | | |
| Sodium Thiosulfate | 150 | g |
| Sodium Sulfite | 15 | g |
| Acetic Acid (28% aq. soln.) | 48 | ml |
| Borax | 7.5 | g |
| Water to make | 1,000 | ml |
| Bleaching Solution | | |
| Potassium Bromide | 20 | g |
| Potassium Ferricyanide | 100 | g |
| Glacial Acetic Acid | 20 | ml |
| Sodium Acetate | 40 | g |
| Water to make | 1,000 | ml |
| Second Fixing Solution | | |
| Sodium Thiosulfate | 200 | g |
| Sodium Acetate | 70 | g |
| Sodium Sulfite | 15 | g |
| Water to make | 1,000 | ml |

After the processing, the transmission optical densities of these samples to blue light and their transmission optical densities to near infrared light using a filter having a maximum absorption at the near infrared region of 750 millimicrons were measured to obtain the following photographic properties. The optical density to near infrared light corresponds to the amount of silver remaining.

TABLE 1

| Film Sample | Fog | Gamma | Relative Sensitivity* | Maximum Density (blue light) | Maximum Density (near infrared light) |
|---|---|---|---|---|---|
| (A) | 0.15 | 2.53 | 100 | 2.36 | 0.15 |
| (B) | 0.15 | 2.50 | 100 | 2.33 | 0.06 |
| (C) | 0.14 | 2.57 | 99 | 2.38 | 0.10 |

TABLE 1-continued

| Film Sample | Fog | Gamma | Relative Sensitivity* | Maximum Density (blue light) | Maximum Density (near infrared light) |
|---|---|---|---|---|---|
| (D) | 0.14 | 2.51 | 99 | 2.34 | 0.04 |

*Relative value of the exposure amount required to give a density of fog + 0.10. Sample (A) was used as a control (100)

Further, referring to these samples, the maximum densities to near infrared light were measured which were obtained upon treatment for different periods of bleaching time. The results shown in Table 2 were obtained.

TABLE 2

| Film Sample | Bleaching Time (seconds) 30 | 40 | 50 | 60 |
|---|---|---|---|---|
| (A) | 0.44 | 0.26 | 0.18 | 0.15 |
| (B) | 0.18 | 0.12 | 0.08 | 0.06 |
| (C) | 0.30 | 0.19 | 0.14 | 0.10 |
| (D) | 0.08 | 0.05 | 0.04 | 0.04 |

As is apparent from the results shown in Table 2 above, according to the present invention the bleaching of silver is accelerated and developed silver is completely removed. Thus the occurrence of color turbidity can be prevented even in a rapid color photographic processing system. Further, photographic sensitivity, gradation and maximum density of color image are not adversely affected according to the present invention. The particle size of the coupler dispersion is somewhat decreased when the present invention is used in the coupler dispersion.

When the polymer having therein the recurring unit represented by the general formula (I) and the polymer having therein the recurring unit represented by the general formula (II) are used together, a synergistic effect in silver removal property is particularly observed and the silver removal property is improved in comparison with the case wherein the copolymer is used individually.

EXAMPLE 2

A solution prepared by heating at 50° C. a mixture of 50 g of the above-described Coupler (103), i.e., a α-(4-carboxyphenoxy)-α-pivaloyl-2-chloro-5-[α-(2,4-di-tert-amylphenoxy)butyramido]acetanilide, 25 ml of di-n-butyl phthalate, 2.5 g of sodium di-(2-ethylhexyl)-α-sulfosuccinate and 100 ml of ethyl acetate was added to 500 ml of an aqueous solution containing 50 g of gelatin. The mixture was mechanically stirred vigorously to finely disperse the coupler together with the solvents. This was designated Dispersion (e).

165 g of Dispersion (e) was added to 200 g of a silver iodobromide emulsion for a reversal film (containing 5.0 mol% iodide, $7.00 \times 10^{-2}$ mol of silver and 12.0 g of gelatin) and 12.5 ml of a 4% aqueous solution of 2-hydroxy-4,6-dichloro-s-triazine sodium salt was added thereto as a hardener. The pH of the mixture was adjusted to 6.5 and the mixture was coated on a polyethylene terephthalate film base in a coated silver amount of 1.10 g/m$^2$. This was designated Sample (E).

Fine Dispersion (f) was prepared in the same manner as for Dispersion (e) except for using 50 g of Coupler (103), 2.5 ml of di-n-butyl phthalate, 45 g of a 50% by weight ethyl acetate solution of the above-described Polymer (7), i.e., a copolymer of tert-butylacrylamide and butylacrylate (molar ratio: 60:40) having a molecular weight of 50,000 and 77.5 ml of ethyl acetate.

Sample (F) was prepared in the same manner as for Sample (E) except for using 165 g of Dispersion (f).

Another sample was prepared by adding 30 ml of a 2% aqueous solution of the above-described Polymer (42), i.e., a copolymer of N-vinylpyrrolidone and vinylacetate (molar ratio: 70:30) having a molecular weight of 200,000 to a coating solution the same as used in Sample (E). This was designated Sample (G).

Still another sample was prepared by adding the same amount of the solution of Polymer (42) to a coating solution the same as used for Sample (F). This was designated Sample (H).

These samples (E), (F), (G) and (H) were subjected to stepwise exposure (100 CMS at a color temperature of 3,200° K.) followed by processing in the following manner.

| Processing Step | Temperature (° C) | Time (minutes) |
|---|---|---|
| 1. First Development | 38 | 3 |
| 2. Washing | 38 | 0.5 |
| 3. Reversal Exposure | Uniform exposure of 8,000 lux · sec. to the emulsion surface | |
| 4. Second Development | 38 | 4 |
| 5. Washing | 38 | 1 |
| 6. Bleaching | 38 | 1 |
| 7. Washing | 30 | 0.5 |
| 8. Fixing | 30 | 1 |
| 9. Washing | 30 | 1 |

The compositions of the processing solutions used were as follows.

| | |
|---|---|
| First Developer Solution | |
| 4-(N-Methylamino)phenol Sulfate | 2 g |
| Sodium Sulfite | 90 g |
| Hydroquinone | 8 g |
| Sodium Carbonate (monohydrate) | 52.5 g |
| Potassium Bromide | 5 g |
| Potassium Thiocyanate | 1 g |
| Water to make | 1,000 ml |
| Second Developer Solution | |
| Benzyl Alcohol | 5 ml |
| Sodium Sulfite | 5 g |
| Hydroxylamine Hydrochloride | 2 g |
| 4-Amino-3-methyl-N-ethyl-N-(β-methanesulfonamidoethyl)aniline Sesquisulfate (monohydrate) | 1.5 g |
| Potassium Bromide | 1 g |
| Trisodium Phosphate | 3 g |
| Ethylenediamine (70% aq. soln.) | 7 ml |
| Water to make | 1,000 ml |
| Bleaching Solution | |
| Potassium Ferricyanide | 100 g |
| Sodium Acetate | 40 g |
| Glacial Acetic Acid | 20 ml |
| Potassium Bromide | 30 g |
| Water to make | 1,000 ml |
| Fixing Solution | |
| Sodium Thiosulfate | 150 g |
| Sodium Acetate | 70 g |
| Sodium Sulfite | 10 g |
| Potassium Alum | 20 g |
| Water to make | 1,000 ml |

After the processing, the transmission optical densities to blue light of these samples and their transmission optical densities to near infrared light using a filter having a maximum absorption at the near infrared region of 750 millimicrons were measured to obtain the following photographic properties.

TABLE 3

| Film Sample | Fog | Gamma | Relative Sensitivity* | Maximum Density (blue light) | Maximum Density (near infrared light) |
|---|---|---|---|---|---|
| (E) | 0.07 | 2.55 | 100 | 2.38 | 0.18 |
| (F) | 0.06 | 2.56 | 100 | 2.38 | 0.10 |
| (G) | 0.07 | 2.53 | 99 | 2.36 | 0.12 |
| (H) | 0.06 | 2.53 | 99 | 2.35 | 0.04 |

*Relative value of exposure amount required to give a density of fog + 0.10. Sample (E) was used as a control.

Further, referring to these samples, the maximum densities to near infrared light which were obtained upon treatment for different periods of bleaching time were measured. The results shown in Table 4 were obtained.

TABLE 4

| Film Sample | Bleaching Time (minutes) 0.5 | 1.0 |
|---|---|---|
| (E) | 0.22 | 0.18 |
| (F) | 0.12 | 0.10 |
| (G) | 0.15 | 0.12 |
| (H) | 0.06 | 0.04 |

It can be understood that the silver removal property is improved and a shortened period of bleaching time can be achieved due to the accelerated bleaching rate and the completeness of removing developed silver without degradations of the photographic properties such as gradation and maximum density can be achieved according to the present invention. The complete removal of developed silver is advantageous from the standpoint of color reproduction and the purity of color and the transparency in a transparent light-sensitive material are improved. Although the above-described properties are improved when the polymer having therein the recurring unit represented by the general formula (I) or the polymer having therein the recurring unit represented by the general formula (II) is used individually, the use of both of these polymers particularly demonstrates the synergistic effect with respect to the silver removal property and achieves superior silver removal property than the case wherein the polymer is used individually and thus is more advantageous.

EXAMPLE 3

A mixture of 50 g of the above-described Coupler (102), i.e., α-(2,4-dioxo-5,5-dimethyloxazolidinyl)-α-pivaloyl-2-chloro-5-[α-(2,4-di-tert-amylphenoxy)-butyramido]-acetanilide, 5 ml of tris-(2-ethylhexyl)-phosphate, 2.5 g of 2,5-dioctylhydroquinone, 50 ml of ethyl acetate, 2.0 g of sodium di-(2-ethylhexyl)-α-sulfosuccinate and 40 g of a 50% by weight ethyl acetate solution of the above-described Polymer (10), i.e., a copolymer of N-(1,1-dimethyl-3-oxobutyl)acrylamide and butylacrylate (molar ratio: 40:60) having a molecular weight of 12,000 was heated at 50° C. to form a solution. The solution was added to 500 ml of an aqueous solution containing 50 g of gelatin and the mixture was vigorously stirred in a homoblender to finely disperse the coupler solution.

400 g of the fine dispersion was added to a silver iodobromide emulsion for a reversal film (containing 5.0 mol% iodide, $18.0 \times 10^{-2}$ mol of silver and 36 g of gelatin) and 42 ml of a 4% aqueous solution of 2-hydroxy-4,6-dichloro-s-triazine sodium salt, as a hardener, and 60 ml of a 2% aqueous solution of the above-described Polymer (41), i.e., a copolymer of vinyl alcohol and vinylpyrrolidone (molar ratio: 30:70) having a molecular weight of 70,000 were added thereto. The pH of the mixture was adjusted to 6.5 to prepare a blue-sensitive emulsion.

To a polyethylene terephthalate film a gelatin solution containing 6% by weight of black colloidal silver to form an antihalation layer at a dry thickness of 2.5 microns was applied, and then as a second layer, a red-sensitive silver halide emulsion containing 2% by weight of a cyan forming coupler (a) described below at a dry thickness of 4.5 microns and a coating amount of 110 $\mu g/cm^2$ as silver was applied.

Cyan-Forming Coupler (a)

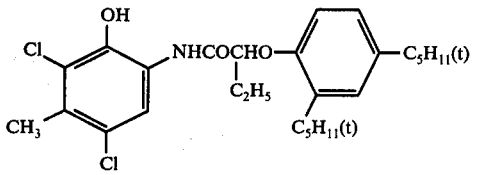

To the film sequentially a gelatin solution containing 0.6% by weight of 2,5-di-tert-octylhydroquinone to form a third layer at a dry thickness of 1.5 microns, a green-sensitive silver halide emulsion containing 2% by weight of a magenta-forming coupler (b) described below to form a fourth layer at a dry thickness of 4.5 microns and a coating amount of 150 $\mu g/cm^2$ as silver and then a gelatin layer containing 6% by weight of yellow colloidal silver as a fifth layer at a dry thickness of 2.0 microns were applied.

Magenta-Forming Coupler (b)

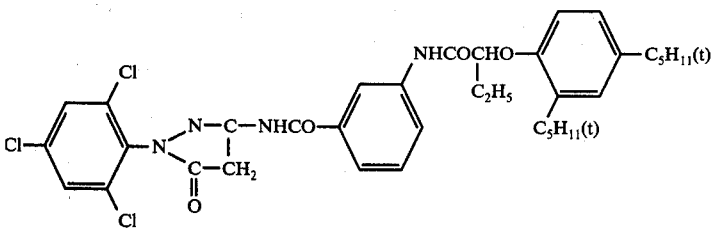

There was applied thereover the above-described blue-sensitive emulsion at a dry thickness of 5.0 microns and a coating amount of 180 $\mu g/cm^2$ as silver and, as an uppermost layer, a protective layer of gelatin at a dry thickness of 1.0 micron to prepare a color photographic film.

The film was exposed and subjected to the following processing.

| Processing Step | Temperature (° C) | Time (seconds) |
|---|---|---|
| First Development | 40 | 5 |
| Color Development | 40 | 15 |
| Stopping | 40 | 10 |
| Bleaching Stabilizing Bath | 40 | 90 |

The processing solutions used had the following compositions.

| | |
|---|---|
| First Developer Solution | |
| 4-(N-Methylamino)phenol Sulfate | 5 g |
| Hydroquinone | 15 g |
| Sodium Sulfite | 80 g |
| Sodium Carbonate (monohydrate) | 41 g |
| Potassium Bromide | 4 g |
| Sodium Hydroxide | 1 g |
| Sodium Thiocyanate | 1.5 g |
| Water to make | 1,000 ml |
| Color Developer Solution | |
| Sodium Sulfite | 5 g |
| 4-Amino-3-methyl-N-ethyl-N-(β-ethoxyethyl)aniline p-Toluenesulfonate | 10 g |
| Trisodium Phosphate (dodecahydrate) | 100 g |
| Tri(hydroxymethyl)nitromethane | 3 g |
| Ethylenediamine (70% aq. soln.) | 11 ml |
| Sodium Hydroxide | 0.1 g |
| Water to make | 1,000 ml |
| Stopping Solution | |
| Sodium Sulfite | 40 g |
| Dihydrogen Sodium Phosphate (dihydrate) | 15 g |
| Sodium Sulfate | 120 g |
| Water to make | 1,000 ml |
| Bleaching Stabilizing Bath | |
| Ferric Disodium Ethylenediaminetetraacetic Acid (monohydrate) | 36 g |
| Ammonium Thiosulfate | 100 g |
| Sodium Sulfite | 7 g |
| Potassium Metabisulfate | 15 g |
| Primary Sodium Phosphate | 20 g |
| Sodium Carbonate (monohydrate) | 6 g |
| Water to make | 1,000 ml |

The reversal color photographic image thus obtained had good transparency because of a smaller amount of developed silver after processing and had clear colors indicating an excellent color reproducibility. This indicates that the use of the two copolymers in combination according to the present invention brings about improvements not only in dispersion and color density of the color image but also in removal of developed silver.

EXAMPLE 4

A solution prepared by heating at 50° C. a mixture of 30 g of the above-described Coupler (115), i.e., 1-(2,4,6-trichlorophenyl)-3-[3-(2,4-di-tert-amylphenoxyacetamido)benzamido]-4-benzenesulfonamido-5-pyrazolone, 30 ml of tricresyl phosphate, 1.5 g of sodium p-dodecylbenzenesulfonate and 50 ml of ethyl acetate was added to 300 ml of an aqueous solution containing 30 g of gelatin. The mixture was mechanically stirred vigorously in a high speed agitator to finely disperse the coupler with the solvents. This was designated Dispersion (i).

123 g of Dispersion (i) was added to 150 g of a silver iodobromide emulsion for a reversal film (containing 5 mol% iodide, $4.5 \times 10^{-2}$ mol of silver and 9 g of gelatin) and 11.5 ml of a 4% aqueous solution of 2-hydroxy-4,6-dichloro-s-triazine sodium salt, as a hardener, thereto. The pH of the mixture was adjusted to 6.5 and the mixture was coated on a cellulose triacetate film support in a coated silver amount of 0.50 g/m$^2$. This was designated Sample (I).

Dispersion (j) was prepared in the same manner as was used for Dispersion (i) except for using 30 g of Coupler (115), 5 ml of tricresyl phosphate and 62.5 g of a 40% by weight ethyl acetate solution of the above-described Polymer (5) of the present invention, i.e., a copolymer of diethylacrylamide and butylacrylate (molar ratio: 40:60) having a molecular weight of 90,000.

Sample (J) was prepared in the same manner as for Sample (I) except for using Dispersion (j).

As a third sample, Sample (K) was prepared by using Dispersion (i) which was used in the preparation of Sample (I), adding 30 ml of a 2% aqueous solution of the above-described Polymer (42), i.e., a copolymer of N-vinylpyrrolidone and vinyl acetate (molar ratio: 70:30) having a molecular weight of 200,000 to a coating solution and coating in a coated silver amount of 0.50 g/m$^2$.

Furthermore, Sample (L) was prepared by using Dispersion (j) and adding the same amount of Polymer (42) as used in Sample (K) to a coating solution used for the preparation of Sample (J).

Samples (I), (J), (K) and (L) thus prepared were subjected to stepwise exposure (100 CMS at a color temperature of 3,200° K.) and processed in the same manner as described in Example 2.

After the processing, the transmission optical density to green light of these samples was measured. Also, the amount of silver remaining in these samples was analyzed using a fluorescence X-ray count meter. The results obtained are shown in the following.

TABLE 5

| Film Sample | Fog | Gamma | Relative Sensitivity* | Maximum Density (green light) | Maximum** Value (fluorescence X-ray count meter) |
|---|---|---|---|---|---|
| (I) | 0.07 | 3.58 | 100 | 3.73 | 5.7 |
| (J) | 0.06 | 3.61 | 100 | 3.75 | 2.1 |
| (K) | 0.06 | 3.55 | 100 | 3.70 | 3.0 |
| (L) | 0.06 | 3.57 | 100 | 3.73 | 0.7 |

*Relative value of exposure amount required to give a density of fog + 0.10. Sample (I) was used as a control.
**The value means the amount of silver remaining. Unit: μg/cm$^2$ Further, in order to determine the variation of the amount of silver remaining where the period of bleaching time was changed, Samples (I), (J), (K) and (L) were subjected to a sufficient amount of uniform exposure (100 CMS at a color temperature of 3,200° K.) and processed in a second development and subsequent steps. The processing times for bleaching were for 20 seconds, 40 seconds, 1 minute and 2 minutes. The results obtained by analysis for silver remaining are shown in Table 6.

TABLE 6

| Film Sample | Bleaching Time (seconds) | | | |
|---|---|---|---|---|
| | 20 | 40 | 60 | 120 |
| (I) | 8.6 | 6.5 | 5.7 | 5.2 |
| (J) | 3.5 | 2.7 | 2.1 | 1.5 |
| (K) | 4.4 | 3.6 | 3.0 | 2.5 |
| (L) | 1.4 | 1.0 | 0.7 | 0.5 |

The value means the amount of silver remaining (μg/cm$^2$).

From the results it is apparent that a shortened period of bleaching time can be achieved due to the accelerated bleaching rate and the completeness of removing the developed silver without degradations of the photographic properties such as gradation and maximum density using the combination of the two polymers according to the present invention.

Although the silver removal property is somewhat improved when a polymer having therein the recurring unit represented by the general formula (I) or the polymer having therein the recurring unit represented by the general formula (II) is used individually, the use of both of the polymers demonstrates the synergistic effect with respect to the silver removal property and achieves superior silver removal property to the case wherein the polymer is used individually and thus is more advantageous. The purity of color and the transparency in a transparent light-sensitive material are improved due to the complete removal of developed silver.

EXAMPLE 5

A solution prepared by heating at 60° C. a mixture of 20 g of the above-described Coupler (107), i.e., α-(N-benzyl-5-ethoxyhydantoinyl)-α-(4-methoxybenzoyl)-2-chloro-5-[α-(2,4-di-tert-amylphenoxy)-butyramido]acetanilide, 10 ml of di-n-butyl phthalate and 40 ml of ethyl acetate was added to 200 ml of an aqueous solution containing 20 g of gelatin and 1.0 g of sodium p-dodecylbenzenesulfonate. The mixture was stirred and then subjected to a vigorously mechanical stirring to finely disperse the coupler together with the solvents. This was designated Dispersion (*m*).

Dispersion (*n*) was prepared in the same manner as Dispersion (*m*) except for using 2 ml of di-n-butyl phthalate and 16 g of a 50% by weight ethyl acetate solution of the above-described Polymer (11) of the present invention, i.e., a copolymer of N-(1,1-dimethyl-3-oxobutylacrylamide and butylacrylate (molar ratio: 50:50) having a molecular weight of 7,000.

Further, Dispersion (*o*) was prepared in the same manner as Dispersion (*m*) except for using 20 ml of a 50% by weight ethyl acetate solution of Polymer (11) of the present invention instead of di-n-butyl phthalate.

Dispersion (*p*) and Dispersion (*q*) were prepared in the same manner as Dispersion (*n*) and Dispersion (*o*) except for using a 50% by weight ethyl acetate solution of the above-described Polymer (17) of the present invention, i.e., a copolymer of acryloylmorpholine and 2-ethoxyethylacrylate (molar ratio: 40:60) having a molecular weight of 100,000, respectively.

The same procedures as Dispersion (*n*) and Dispersion (*o*) were repeated except for using Polymer (24), i.e., a copolymer of N-methyl-N'-methacryloylpiperazine and 2-ethoxyethylacrylate (molar ratio: 30:70) having a molecular weight of 10,000, Polymer (25), i.e., a copolymer of 3,5-dimethylmorpholinomethacrylamide and butylacrylate (molar ratio: 50:50) having a molecular weight of 8,000 and Polymer (26), i.e., a copolymer of tert-butylacrylamide, butylacrylate and 2-ethoxyethylacrylate (molar ratio: 45:30:25) having a molecular weight of 40,000 of the present invention to prepare Dispersions (*r*), (*s*), (*t*), (*u*), (*v*) and (*w*), respectively.

90 g of each of the 11 dispersions, Dispersions (*m*) to (*w*) thus prepared, was added to 100 g of a silver iodobromide emulsion (containing 5 mol% iodide, 3.0 × $10^{-2}$ mol of silver and 7 g of gelatin) and 10 ml of a 4% aqueous solution of 2-hydroxy-4,6-dichloro-s-triazine sodium salt, as a hardener, and 20 ml of a 2% aqueous solution of the above described Polymer (41), i.e., a copolymer of vinyl alcohol and N-vinylpyrrolidone (molar ratio: 30:70) having a molecular weight of 70,000 were added thereto. The pH of the mixture was adjusted to 6.5 and the mixture was coated on a cellulose triacetate film support in a coated silver amount of 0.60 g/m$^2$. These were designated Samples (M) to (W), respectively.

The average particle sizes of Dispersions (*m*) to (*w*) were measured using a light scattering method and the results shown in Table 7 were obtained.

These Samples (M) to (W) were subjected to sensitometric stepwise exposure (100 CMS at a color temperature of 3,200° K.) and processed in the same manner as described in Example 1 except for developing at 32° C. for 6 minutes using a color developer solution having the composition described below.

| Color Developer Solution | |
|---|---|
| Benzyl Alcohol | 5 ml |
| Sodium Hydroxide | 0.5 g |
| Diethylene Glycol | 3 ml |
| Sodium Hexametaphosphate | 2 g |
| Sodium Sulfite | 2 g |
| Potassium Bromide | 2 g |
| 4-Amino-3-methyl-N-ethyl-N-(β-methanesulfonamido ethyl) aniline Sesquisulfate (monohydrate) | 5 g |
| Metaboric Acid | 0.5 g |
| Sodium Metaborate (tetrahydrate) | 77 g |
| Water to make | 1,000 ml |

After the processing, the transmission optical densities to blue light of these samples and their transmission optical densities to near infrared light using a filter having a maximum absorption at the near infrared region of 750 millimicrons were measured to obtain the following photographic properties (A).

Furthermore, these samples were processed in the same manner as described in Example 3 except for deleting the first development from the processing steps and after processing, the transmission optical densities to near infrared light (B) using a filter having a maximum absorption at the near infrared region of 750 millimicrons of these samples were measured. The results obtained are also shown in Table 7.

TABLE 7

| Polymer(s) of the Present Invention | Dispersion | Coated Film | (A) Fog | (A) Gamma | (A) Relative Sensitivity* | (A) Maximum Density (blue light) | (A) Maximum Density (near infrared light) | (B) Maximum Density (near infrared light) | Average Particle Size of Dispersion (micron) |
|---|---|---|---|---|---|---|---|---|---|
| 41 | m | M | 0.12 | 2.11 | 100 | 2.24 | 0.14 | 0.31 | 0.20 |
| 41-11 | n | N | 0.12 | 2.07 | 99 | 2.21 | 0.06 | 0.08 | 0.19 |
| 41-11 | o | O | 0.11 | 2.05 | 98 | 2.20 | 0.05 | 0.08 | 0.19 |
| 41-17 | p | P | 0.12 | 2.13 | 100 | 2.25 | 0.07 | 0.13 | 0.19 |
| 41-17 | q | Q | 0.11 | 2.10 | 99 | 2.23 | 0.05 | 0.11 | 0.20 |
| 41-24 | r | R | 0.10 | 2.08 | 99 | 2.23 | 0.06 | 0.10 | 0.18 |
| 41-24 | s | S | 0.10 | 2.10 | 99 | 2.24 | 0.05 | 0.07 | 0.18 |
| 41-25 | t | T | 0.12 | 2.15 | 100 | 2.26 | 0.06 | 0.09 | 0.19 |
| 41-25 | u | U | 0.10 | 2.12 | 99 | 2.25 | 0.04 | 0.07 | 0.18 |
| 41-26 | v | V | 0.09 | 2.14 | 98 | 2.24 | 0.04 | 0.05 | 0.17 |
| 41-26 | w | W | 0.09 | 2.11 | 98 | 2.21 | 0.03 | 0.04 | 0.17 |

*Relative value of exposure amount required to give a density of fog + 0.10. Coated Film (M) was used as a control (100).

From these results it is apparent that the use of the two polymers in combination according to the present invention can provide a fine dispersion and reduce the amount of developed silver remaining without degradation of photographic properties such as gradation and color density.

EXAMPLE 6

A solution prepared by heating at 60° C. a mixture of 10 g of the above-described Coupler (103), i.e., α-(4-carboxyphenoxy)-α-pivaloyl-2-chloro-5-[α-(2,4-di-tertamylphenoxy)butyramido]acetanilide, 5 ml of di-n-butyl phthalate, 0.5 g of sodium di-(2-ethylhexyl)-α-sulfosuccinate and 20 ml of ethyl acetate was added to 100 ml of an aqueous solution containing 10 g of gelatin. The mixture was stirred and then subjected to a vigorous mechanical stirring to finely disperse the coupler together with the solvents. This was designated Dispersion (*x*−1).

A dispersion was prepared in the same manner as Dispersion (*x*−1) except for using 2.5 ml of di-n-butyl phthalate and 5.0 g of a 50% by weight ethyl acetate solution of the above-described Polymer (12), i.e., a copolymer of tert-butylacrylamide and butylacrylate (molar ratio: 50:50) having a molecular weight of 60,000. This was designated Dispersion (*x*−2).

Further, Dispersion (*x*−3) was prepared in the same manner as Dispersion (*x*−1) except for using 1.0 ml of di-n-butyl phthalate and 8.0 g of a 50% by weight ethyl acetate solution of Polymer (12).

Furthermore, Dispersion (*x*−4) was prepared in the same manner as Dispersions (*x*−1), (*x*−2) and (*x*−3) except for using 10.0 g of a 50% by weight ethyl acetate solution of Polymer (12) instead of di-n-butyl phthalate.

All of each of Dispersions (*x*−1), (*x*−2), (*x*−3) and (*x*−4) thus prepared was added to 164 g of a silver iodobromide emulsion for a reversal film (containing 4 mol% iodide, 5.67 × 10$^{-2}$ mol of silver and 10.5 g of gelatin) and 15.5 ml of a 4% aqueous solution of 2-hydroxy-4,6-dichloro-s-triazine sodium salt, as a hardener, was added thereto and further 31 ml of a 2% aqueous solution of the above-described Polymer (41), i.e., a copolymer of vinyl alcohol and N-vinylpyrrolidone (molar ratio: 30:70) having a molecular weight of 70,000 was added to the coating mixture containing Dispersion (*x*−2), (*x*−3) or (*x*−4) but for the coating mixture containing Dispersion (*x*−1). The pH of the mixture was adjusted to 7.0 and the mixture was coated on a cellulose triacetate film support in a coated silver amount of 1.00 g/m$^2$. These were designated Samples (*x*−1), (*x*−2), (*x*−3) and (*x*−4), respectively.

These samples thus obtained were subjected to sensitometric stepwise exposure (100 CMS at a color temperature of 3,200° K.) and processed in the following manner.

| Processing Step | Temperature (°) | Time (minutes) |
|---|---|---|
| 1. Hardening Bath | 30 | 1 |
| 2. Washing | " | 1 |
| 3. First Development | " | 3 |
| 4. Washing | " | 0.5 |

-continued

| Processing Step | Temperature (°) | Time (minutes) |
|---|---|---|
| 5. Reversal Exposure | Uniform exposure of 8,000 lux . sec. to the emulsion surface | |
| 6. Second Development | 30 | 4 |
| 7. Washing | " | 1 |
| 8. Bleaching | " | 1 |
| 9. Washing | " | 0.5 |
| 10. Fixing | " | 1 |
| 11. Washing | " | 1 |

The processing solutions used had the following composition.

| | |
|---|---|
| Hardening Bath | |
| Sulfuric Acid (98%, 1:1 by weight with $H_2O$) | 5.4 ml |
| Sodium Sulfate | 150 g |
| Sodium Acetate | 20 g |
| Formaldehyde (40% aq. soln.) | 10 ml |
| Pyruvaldehyde (40% aq. soln.) | 10 ml |
| Water to make | 1,000 ml |
| First Developer Solution | |
| 4-(N-Methylamino)phenol Sulfate | 2 g |
| Sodium Sulfite | 90 g |
| Hydroquinone | 8 g |
| Sodium Carbonate (monohydrate) | 52.5 g |
| Potassium Bromide | 5 g |
| Potassium Thiocyanate | 1 g |
| Water to make | 1,000 ml |
| Second Developer Solution | |
| Benzyl Alcohol | 5 ml |
| Sodium Sulfite | 5 g |
| Hydroxylamine Hydrochloride | 2 g |
| 4-Amino-3-methyl-N-ethyl-N-(β-ethoxyethyl)aniline p-Toluenesulfonate | 3 g |
| Potassium Bromide | 1 g |
| Trisodium Phosphate | 30 g |
| Sodium Hydroxide | 0.5 g |
| Ethylenediamine (70% aq. soln.) | 7 ml |
| Water to make | 1,000 ml |
| Bleaching Solution | |
| Potassium Ferricyanide | 100 g |
| Sodium Acetate | 40 g |
| Glacial Acetic Acid | 20 ml |
| Potassium Bromide | 30 g |
| Water to make | 1,000 ml |
| Fixing Solution | |
| Sodium Thiosulfate | 150 g |
| Sodium Acetate | 70 g |
| Sodium Sulfite | 10 g |
| Potassium Alum | 20 g |
| Water to make | 1,000 ml |

After the processing the transmission optical densities to blue light of these samples and their transmission optical densities to near infrared light using a filter having a maximum absorption at the near infrared region of 750 millimicrons were measured to obtain the results as shown in Table 8.

TABLE 8

| Film Sample | Fog | Gamma | Relative Sensitivity* | Maximum Density (blue light) | Maximum Density (near infrared light) |
|---|---|---|---|---|---|
| (x-1) | 0.06 | 3.12 | 100 | 2.93 | 0.28 |
| (x-2) | 0.06 | 3.13 | 100 | 2.93 | 0.12 |
| (x-3) | 0.05 | 3.09 | 99 | 2.90 | 0.06 |
| (x-4) | 0.05 | 3.07 | 99 | 2.98 | 0.05 |

*Relative value of exposure amount required to give a density of fog + 0.10. Sample (x-1) was used as a control.

Further, the transmission maximum densities to near infrared light of these samples were measured which were obtained upon treatment for different periods of bleaching time. The results shown in Table 9 were obtained.

TABLE 9

| Film Sample | Bleaching Time (minutes) 0.5 | 1 | 3 |
|---|---|---|---|
| (x-1) | 0.57 | 0.28 | 0.12 |
| (x-2) | 0.20 | 0.12 | 0.07 |
| (x-3) | 0.09 | 0.06 | 0.04 |
| (x-4) | 0.07 | 0.05 | 0.03 |

From the results it is apparent that the use of the two copolymers of the present invention in combination remarkably improves the silver removal property without degradation of photographic properties and this is advantageous from the standpoint of color reproduction. It was also found that the silver removal property was further improved as the amount of Polymer (12) was increased instead of the high boiling solvent.

EXAMPLE 7

A solution prepared by heating at 50° C. a mixture of 50 g of the above-described Coupler (102), i.e., α-(2,4-dioxo-5,5-dimethyloxazolidinyl)-α-pivaloyl-2-chloro5-[α-(2,4-di-tert-amylphenoxy)butyramido]acetanilide, 25 ml of di-n-butyl phthalate, 2.5 g of sodium di-(2-ethylhexyl)-α-sulfosuccinate and 100 ml of ethyl acetate was added to 500 ml of an aqueous solution containing 50 g of gelatin. The mixture was subjected to a vigorous mechanical stirring to finely disperse the coupler together with the solvents. This was designated Dispersion (y).

410 g of Dispersion (y) was added to 500 g of a silver iodobromide emulsion for a reversal film (containing 6 mol% iodide, 0.175 mol of silver and 32.5 g of gelatin) and the mixture was equally divided into 5 parts which were designated (y−1), (y−2), (y−3), (y−4) and (y−5).

A 4% aqueous solution of 2-hydroxy-4,6-dichlorostriazine sodium salt, as a hardener, was added to (y−1), (y−2), (y−3), (y−4) and (y−5) in an amount of 3.2 ml, 4.7 ml, 6.3 ml, 7.9 ml and 9.5 ml, respectively. The pH of the mixture was adjusted to 7.0 and the mixture was coated on a polyethylene terephthalate film support in a coated silver amount of 1.00 g/m². These were designated Samples (y−1), (y−2), (y−3), (y−4) and (y−5), respectively.

Further, a dispersion was prepared in the same manner as Dispersion (y) except for using 5 ml of di-n-butyl phthalate and 40 g of a 50% by weight ethyl acetate solution of Polymer (12) of the present invention, i.e., a copolymer of tert-butylacrylamide and butylacrylate (molar ratio: 50:50) having a molecular weight of 60,000. This was designated Dispersion (z).

410 g of Dispersion (z) was added to 500 g of a silver iodobromide emulsion for a reversal film the same as above, and 100 ml of a 2% aqueous solution of the abovedescribed Polymer (42), i.e., a copolymer of N-vinylpyrrolidone and vinyl acetate (molar ratio: 70:30) having a molecular weight of 200,000 was added thereto and then the mixture was equally divided into 5 parts which were designated (z−1), (z−2), (z−3), (z−4) and (z−5). The above described hardener was added to (z−1), (z−2), (z−3), (z−4) and (z−5) in an amount of 3.2 ml, 4.7 ml, 6.3 ml, 7.9 ml and 9.5 ml, respectively. The pH of the mixture was adjusted to 7.0 and the mixture was coated on a polyethylene terephthalate film support in a coated silver amount of 1.00 g/m². These were designated Samples (z−1), (z−2), (z−3), (z−4) and (z−5), respectively.

The coated samples were stored in a room at a controlled temperature and humidity of 25° C. and 60% relative humidity for 10 days. Then the samples were subjected to sensitometric stepwise exposure and processed in the same procedure as described in Example 7.

After the processing, the transmission optical densities to blue light of these samples and their transmission optical density to near infrared light using a filter having a maximum absorption at the near infrared region of 750 millimicrons were measured to obtain the results as shown in Table 10.

TABLE 10

| Film Sample | Fog | Gamma | Relative Sensitivity* | Maximum Density (blue light) | Maximum Density (near infrared light) |
|---|---|---|---|---|---|
| (y-1) | 0.07 | 3.36 | 100 | 3.05 | 0.11 |
| (y-2) | 0.07 | 3.35 | 100 | 3.05 | 0.15 |
| (y-3) | 0.06 | 3.33 | 100 | 3.03 | 0.20 |
| (y-4) | 0.06 | 3.32 | 99 | 3.02 | 0.26 |
| (y-5) | 0.06 | 3.29 | 98 | 3.00 | 0.30 |
| (z-1) | 0.07 | 3.37 | 100 | 3.05 | 0.03 |
| (z-2) | 0.06 | 3.34 | 100 | 3.04 | 0.03 |
| (z-3) | 0.06 | 3.34 | 99 | 3.04 | 0.04 |
| (z-4) | 0.06 | 3.31 | 99 | 3.01 | 0.04 |
| (z-5) | 0.05 | 3.30 | 98 | 3.01 | 0.05 |

*Relative value of exposure amount required to give a density of fog + 0.10. Sample (y-1) was used as a control.

From the results above it is apparent that even when the amount added of the hardener increases to three times that of a certain amount of gelatin, sufficient removal of silver can be achieved by the use of the two copolymers of the present invention in combination. The fact that a hardener can be added to an emulsion in a large amount provides the possibility of deleting a step in the processing, particularly a pre-hardening bath and a washing step in reversal processing and it is advantageous for decreasing the number of processing baths and rapid processing as well to improve color reproduction due to improved silver removal property. On the contrary, it can be seen that the amount of developed silver remaining increases as the amount of the hardener added increases and the purity and transparency of the color image apparently is degraded in the case where the polymers according to the present invention are not used.

EXAMPLE 8

A solution prepared by heating at 60° C. a mixture of 18 g of the above-described Coupler (119), i.e., 5-methyl-4,6-dichloro-2-[α-(3-n-pentadecylphenoxy)-butyramido]-phenol, 2.0 g of Coupler (121), i.e., 5-methoxy-2-[α-(3-n-pentadecylphenoxy)butyramido]-4-(1-phenyl-5-tetrazolylthio)phenol, 20 ml of di-n-butyl phthalate and 40 ml of ethyl acetate was added to 200 ml of an aqueous solution containing 1 g of sodium p-dodecylbenzenesulfonate and 20 g of gelatin.

The mixture was subjected to a vigorous mechanical stirring to finely disperse the coupler with the solvents. This was designated Dispersion (*a*°).

120 g of Dispersion (*a*°) was added to 200 g of a silver iodobromide emulsion for a reversal film (containing 6 mol% iodide, $6.0 \times 10^{-2}$ mol of silver and 13 g of gelatin) and the mixture was equally divided into 2 parts which were designated (*a*°-1) and (*a*°-2). A 4% aqueous solution of 2-hydroxy-4,6-dichloro-5-s-triazine sodium salt, as a hardener, was added to (*a*°-1) and (*a*°-2) in an amount of 2.7 ml and 8.0 ml, respectively. The pH of the mixture was adjusted to 7.0 and the mixture was coated on a polyethylene terephthalate film support in a dry thickness of 5.0 microns. These were designated Sample (A-1) and (A-2), respectively.

Further, a dispersion was prepared in the same manner as Dispersion (*a*°) except for using 50 g of a 40% by weight ethyl acetate solution of Polymer (21) of the present invention, i.e., a copolymer of N-acryloylpiperidine and butylacrylate (molar ratio: 50:50) having a molecular weight of 140,000 in place of all of the di-n-butyl phthalate in Dispersion (*a*°). This was designated Dispersion (*b*°).

120 g of Dispersion (*b*°) was added to 200 g of a silver iodobromide emulsion for a reversal film the same as above, and 40 ml of a 2% aqueous solution of the above described Polymer (41), i.e., a copolymer of vinyl alcohol and N-vinylpyrrolidone (molar ratio: 30:70) having a molecular weight of 70,000 was added thereto and then the mixture was equally divided into 2 parts which were designated (*b*°-1) and (*b*°-2). The above-described solution of hardener was added to (*b*°-1) and (*b*°-2) in an amount of 2.7 ml and 8.0 ml, respectively. The pH of the mixture was adjusted to 7.0 and the mixture was coated on a polyethylene terephthalate film support in a dry thickness of 5.0 microns. These were designated Samples (B-1) and (B-2), respectively.

The coated samples were stored in a room at a controlled temperature and humidity of 25° C. and 60% relative humidity for 10 days. Then the samples were processed using the same procedure as described in Example 6 without exposure. After processing, the amount of silver remaining in the sample was determined using a fluorescence X-ray count meter and the results shown below are obtained.

TABLE 11

| Film Sample | Remaining Silver Amount ($\mu g/cm^2$) |
|---|---|
| (A-1) | 1.4 |
| (A-2) | 3.9 |
| (B-1) | 0.6 |
| (B-2) | 0.7 |

Further, these samples were processed using the same procedure as described in Example 6 but just after the bleach bath step, the thickness of the emulsion layer of the samples was measured. Furthermore, these samples were processed in the same manner without the pre-hardening bath and the thickness of the emulsion layer of the samples was measured in the same manner as above. The thickness of the emulsion layer after the bleach bath step thus measured was compared to the thickness of the emulsion layer before processing and the degree of swelling of the emulsion layer during processing was determined. The results obtained are shown in Table 12.

TABLE 12

| Processing | Film Sample | Thickness of Emulsion Layer (micron) | Degree of Swelling* |
|---|---|---|---|
| With Pre-hardening | | | |
| | (A-1) | 41.5 | 8.3 |
| | (A-2) | 15.8 | 3.2 |
| | (B-1) | 41.2 | 8.2 |
| | (B-2) | 15.5 | 3.1 |
| Without Pre-hardening | | | |
| | (A-1) | 57.8 | 11.6 |
| | (A-2) | 17.7 | 3.5 |
| | (B-1) | 57.4 | 11.5 |
| | (B-2) | 17.5 | 3.5 |
| Before Processing | | | |

TABLE 12-continued

| Processing | Film Sample | Thickness of Emulsion Layer (micron) | Degree of Swelling* |
|---|---|---|---|
| | (A-1) | 5.0 | — |
| | (A-2) | 5.0 | — |
| | (B-1) | 5.0 | — |
| | (B-2) | 5.0 | — |

*Thickness of emulsion layer after processing/thickness of emulsion layer before processing.

From the results shown in Table 11 and Table 12, it is apparent that the silver removal property was improved and a color photographic light-sensitive material which provides a small amount of silver remaining and superior color purity and transparency by the use of the copolymers of the present invention in combination was obtained. Further, when the two copolymers are used in combination according to the present invention, it is observed that superior silver removal property is maintained even as the amount of hardener increases. Also, it is found that in the combined use of the two copolymers of the present invention the effect of hardener is not degraded. Therefore, according to the present invention it is possible to increase the amount of hardener in a light-sensitive material and to decrease the number of steps of processing and to shorten the processing time.

EXAMPLE 9

A solution prepared by heating at 50° C. a mixture of 50 g of the above-described Coupler (103), i.e., α-(4-carboxyphenoxy)-α-pivaloyl-2-chloro-5-[α-(2,4-di-ter-tamylphenoxy)butyramido]acetanilide, 25 ml of di-n-butyl phthalate and 100 ml of ethyl acetate was added to 500 ml of an aqueous solution containing 50 g of gelatin and 2.5 g of sodium α-sulfosuccinate. The mixture was stirred and then subjected to a vigorous mechanical stirring to finely disperse the coupler together with the solvents. This was designated Dispersion (*c*°).

From the dispersion, four parts each weighing 83.5 g were separated which were designated (*c*-1), (*c*-2), (*c*-3) and (*c*-4). Each of the dispersions was added to 100 g of a silver iodobromide emulsion (containing 5 mol% iodide, $3.5 \times 10^{-2}$ mol of silver and 7 g of gelatin) and 6.6 ml of a 4% aqueous solution of 2-hydroxy-4,6-dichloro-s-triazine sodium salt, as a hardener, was added thereto. Further, there were added 10 ml of a 5% aqueous solution of the above-described Polymer (31), i.e., poly(N-vinyloxazolidone) having a molecular weight of 300,000 to (*c*-2), 10 ml of a 5% aqueous solution of the above-described Polymer (43), i.e., a copolymer of N-vinylpyrrolidone and 2-hydroxyethylacrylate (molar ratio: 80:20) having a molecular weight of 180,000, to (*c*-3), 10 ml of a 5% aqueous solution of the above-described Polymer (48), i.e., a copolymer of N-vinyloxazolidone and vinyl alcohol (molar ratio: 65:35) having a molecular weight of 200,000 to (*c*-4), and 10 ml of a 5% aqueous solution of the above-described Polymer (62), i.e., a copolymer of N-vinylpyrrolidone and dimethylacrylamide (molar ratio: 70:30) having a molecular weight of 580,000 to (*c*-5), respectively. The pH of the mixture was adjusted to 6.0 and the mixture was coated on a cellulose triacetate film support in a coated silver amount of 0.80 g/m². These were designated Samples (*c*-1), (*c*-2), (*c*-3), (*c*-4) and (*c*-5), respectively.

Samples (D-1), (D-2), (D-3), (D-4) and (D-5) were prepared in the same manner as Samples (*c*-1) to (*c*-5), respectively, except for using 10 ml of di-n-butyl phthalate, 70 ml of ethyl acetate and 45 g of a 33% by weight ethyl acetate solution of the above described Polymer (26), i.e., a copolymer of tert-butylacrylamide, butylacrylate and 2-ethoxyethylacrylate (molar ratio: 45:30:25) having a molecular weight of 40,000 in the coupler dispersion.

These Samples (*c*-1) to (*c*-5) and (D-1) to (D-5) were uniformly exposed (100 CMS at a color temperature of 3,200° K.) sufficiently and processed in the following manner. The bleaching step was carried out for a period of 0.5 minute, 1 minute, 1.5 minutes, 3 minutes or 5 minutes.

| Processing Step | Temperature (° C) | Time (minutes) |
|---|---|---|
| 1. Color Development | 38 | 3 |
| 2. Washing | " | 1 |
| 3. Bleaching | " | (0.5, 1, 1.5, 3, 5) |
| 4. Washing | " | 1 |
| 5. Fixing | " | 2 |
| 6. Washing | " | 2 |
| 7. Drying | | |

The processing solutions used had the following compositions.

| | |
|---|---|
| Color Developer Solution | |
| Benzyl Alcohol | 5 ml |
| Sodium Hydroxide | 0.5 g |
| Diethylene Glycol | 3 ml |
| Sodium Hexametaphosphate | 2 g |
| Sodium Sulfite | 2 g |
| Potassium Bromide | 2 g |
| 4-Amino-3-methyl-N-ethyl-N-(β-hydroxyethyl)aniline Monosulfate | 5 g |
| Metaboric Acid | 0.5 g |
| Sodium Metaborate (tetrahydrate) | 77 g |
| Water to make | 1,000 ml |
| Bleaching Solution | |
| Potassium Ferrocyanide | 8 g |
| Potassium Ferricyanide | 30 g |
| Potassium Bromide | 20 g |
| Borax (pentahydrate) | 15 g |
| Boric Acid | 5 g |
| Disodium Ethylenediaminetetraacetate (dihydrate) | 1 g |
| Water to make | 1,000 ml |
| Fixing Solution | |
| Sodium Hexametaphosphate | 1 g |
| Sodium Sulfite | 5 g |
| Sodium Thiosulfate | 150 g |
| Acetic Acid | 8 ml |
| Water to make | 1,000 ml |

After the processing, the transmission optical density to near infrared light using a filter having a maximum absorption at the near infrared region of 750 millimicrons of these samples were measured to obtain the results as follows.

TABLE 13

| Film Sample | Polymer Used: General Formula (I) | Polymer Used: General Formula (II) | Bleaching Time (minutes) 0.5 | 1 | 1.5 | 3 | 5 |
|---|---|---|---|---|---|---|---|
| c-1 | | — | 0.24 | 0.21 | 0.17 | 0.18 | 0.17 |
| c-2 | | (31) | 0.16 | 0.14 | 0.13 | 0.12 | 0.11 |
| c-3 | | (43) | 0.12 | 0.11 | 0.10 | 0.09 | 0.09 |
| c-4 | | (48) | 0.13 | 0.11 | 0.10 | 0.09 | 0.09 |
| c-5 | | (62) | 0.13 | 0.12 | 0.11 | 0.10 | 0.09 |
| D-1 | (26) | — | 0.13 | 0.11 | 0.10 | 0.09 | 0.08 |
| D-2 | " | (31) | 0.09 | 0.08 | 0.07 | 0.07 | 0.06 |
| D-3 | " | (43) | 0.08 | 0.07 | 0.06 | 0.05 | 0.05 |
| D-4 | " | (48) | 0.07 | 0.06 | 0.05 | 0.05 | 0.04 |
| D-5 | " | (62) | 0.07 | 0.06 | 0.06 | 0.05 | 0.05 |

From these results it is apparent that the silver removal property is improved with a high silver removal rate and with complete removal of developed silver and this is advantageous from the standpoint of color reproduction by the use of the two compolymers in combination according to the present invention.

As illustrated in the above examples, when both the polymer having therein a recurring unit represented by the general formula (I) and the polymer having therein a recurring unit represented by the general formula (II) are used in combination, removal of silver is carried out at an unexpectedly high rate in comparison with the case when the polymer is used individually.

Further, some of the advantageous effects of the present invention are set forth as follows.

(i) The particle size of a coupler dispersion can be reduced.

(ii) Photographic properties such as gradation, maximum density, etc., of the dye images obtained are not impaired.

(iii) Silver is removed rapidly even from an emulsion layer which has been hardened to a high degree.

(iv) Silver is completely removed and transparent color images are obtained.

(v) The present invention is particularly effective in a reversal processing. (vi) The present invention can be advantageously used where a two-equivalent coupler, a development inhibitor releasing coupler or a development inhibitor releasing compound is present.

(vii) The fastness of the dye images is excellent.

These effects are particularly remarkable when a hydrophobic two-equivalent yellow coupler or a hydrophobic two-equivalent magenta coupler is used.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material having at least one gelatin silver halide emulsion layer containing an organic solvent dispersed therein, wherein said solvent contains a hydrophobic coupler and a polymer having a recurring unit represented by the following general formula (I):

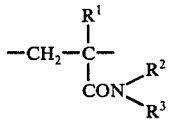

(I)

wherein $R^1$ represents a hydrogen atom or a lower alkyl group, and $R^2$ and $R^3$, which may be the same or different, each represents a hydrogen atom, an aliphatic hydrocarbon group, an aromatic hydrocarbon group, an alkyl-substituted amino group or an aryl-substituted amino group, with the proviso that both of $R^2$ and $R^3$ are not simultaneously hydrogen atoms, the total number of carbon atoms of $R^2$ and $R^3$ is 4 or more, $R^2$ and $R^3$ do not contain an acidic group and $R^2$ and $R^3$ can combine together to form a ring;

wherein a gelatin continuous phase in said gelatin silver halide emulsion layer contains a polymer having a recurring unit represented by the following general formula (II):

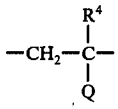

(II)

wherein $R^4$ has the same meaning as defined for $R^1$; and Q represents:

(1) $-(CH_2)_pOH$ wherein $p$ represents 0 or 1,

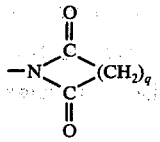

(2)

wherein $q$ represents an integer of 2 to 4,

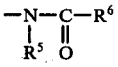

(3)

wherein $R^5$ represents an alkyl group; and $R^6$ represents a hydrogen atom or an alkyl group,

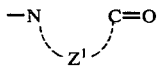

(4)

wherein $Z^1$ represents the atoms necessary to form a lactam ring, an oxazolidone ring or a pyridone ring, or

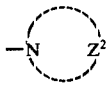

(5)

wherein $Z^2$ represents the atoms necessary to form a morpholine ring.

2. The color photographic light-sensitive material as claimed in claim 1, wherein the lower alkyl group represented by $R^1$ is an alkyl group having 1 to 3 carbon atoms.

3. The color photographic light-sensitive material as claimed in claim 1, wherein the polymer having therein a recurring unit represented by the general formula (I) is a homopolymer or a copolymer of at least one monomer represented by the general formula (IA):

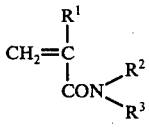

(IA)

wherein $R^1$, $R^2$ and $R^3$ each has the same meaning as defined in claim 1.

4. The color photographic light-sensitive material as claimed in claim 1, wherein the polymer having therein a recurring unit represented by the general formula (I) is a copolymer of at least one monomer represented by the general formula (IA):

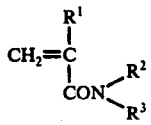

(IA)

wherein $R^1$, $R^2$ and $R^3$ each has the same meaning as defined in claim 1, with at least one other unsaturated monomer copolymerizable therewith.

5. The color photographic light-sensitive material as claimed in claim 1, wherein R represents a hydrogen atom and Q represents:

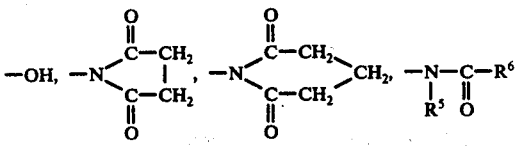

wherein $R^5$ represents a methyl group or an ethyl group and $R^6$ represents a hydrogen atom, a methyl group or an ethyl group, or

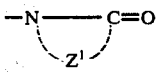

wherein $Z^1$ represents the atoms necessary to form a 5-membered or 6-membered lactam ring or an oxazolidone ring.

6. The color photographic light-sensitive material as claimed in claim 1, wherein the polymer contains about 10 to about 100 mol% of the unit represented by the general formula (I).

7. The color photographic light-sensitive material as claimed in claim 1, wherein the polymer contains about 50 to about 100 mol% of the unit represented by the general formula (II).

8. The color photographic light-sensitive material as claimed in claim 1, wherein the hydrophobic coupler has a two-equivalent coupler.

9. The color photographic light-sensitive material as claimed in claim 1, additionally containing a compound releasing a development inhibitor upon development.

* * * * *